US006978991B2

(12) United States Patent
Stevens et al.

(10) Patent No.: US 6,978,991 B2
(45) Date of Patent: Dec. 27, 2005

(54) STREAK FREE APPARATUS FOR PROCESSING AND STACKING PRINTED FORMS

(76) Inventors: Kenneth A. Stevens, 701 N. Raddant Rd., Batavia, IL (US) 60510-4218; Douglas A. Keller, 3 Carolee Ct., West Islip, NY (US) 11795

( * ) Notice: Subject to any disclaimer, the term of this patent is extended or adjusted under 35 U.S.C. 154(b) by 0 days.

(21) Appl. No.: 10/360,489

(22) Filed: Feb. 6, 2003

(65) Prior Publication Data

US 2003/0173729 A1 Sep. 18, 2003

Related U.S. Application Data

(62) Division of application No. 09/777,334, filed on Feb. 6, 2001, now Pat. No. 6,592,114.

(51) Int. Cl.[7] ..... B65H 39/00

(52) U.S. Cl. ..... 271/3.2; 271/3.14; 271/189; 270/52.09; 270/58.01

(58) Field of Search ..... 270/52.01, 52.02, 270/52.09, 58.01, 58.07, 59, 58.23; 271/272, 198, 199, 3.14, 3.2, 7, 306, 189, 9.11, 9.12, 9.13

(56) References Cited

U.S. PATENT DOCUMENTS 4,875,668 A * 10/1989 Spyra ..... 270/45
5,180,157 A * 1/1993 Helit et al. ..... 271/256
5,188,353 A * 2/1993 Parks ..... 271/184
5,203,551 A * 4/1993 Lowell et al. ..... 270/59
5,322,275 A * 6/1994 Gardellini et al. ..... 271/306
5,433,431 A * 7/1995 Lowell ..... 271/273
5,445,368 A * 8/1995 Lester et al. ..... 270/59
5,518,355 A * 5/1996 Watanabe et al. ..... 414/396
5,570,172 A * 10/1996 Acquaviva ..... 399/403
5,590,873 A * 1/1997 Smart et al. ..... 271/303
5,651,445 A * 7/1997 Stevens et al. ..... 198/447
5,818,724 A * 10/1998 Brewster et al. ..... 700/220
5,860,643 A * 1/1999 Moser et al. ..... 270/58.07
5,887,864 A * 3/1999 Stevens et al. ..... 270/52.07
5,915,686 A * 6/1999 Neifert et al. ..... 271/198
5,947,461 A * 9/1999 Holbrock ..... 270/52.09
6,010,123 A * 1/2000 Stevens et al. ..... 270/52.08
6,062,556 A * 5/2000 McCay ..... 271/9.13
6,109,603 A * 8/2000 Stevens et al. ..... 270/52.07
6,131,053 A * 10/2000 Nyffenegger et al. ..... 700/220
6,176,483 B1 * 1/2001 Malevanchik ..... 271/270
6,244,584 B1 * 6/2001 Holbrook et al. ..... 271/3.07
6,305,680 B1 * 10/2001 Allen et al. ..... 270/45
6,341,773 B1 * 1/2002 Aprato et al. ..... 271/9.13
6,364,305 B1 * 4/2002 Sussmeier et al. ..... 270/52.09
6,467,763 B1 * 10/2002 Depoi et al. ..... 270/52.09
6,575,457 B2 * 6/2003 Bakoledis ..... 271/223
6,592,114 B2 * 7/2003 Stevens et al. ..... 270/58.07
6,644,657 B2 * 11/2003 Wright et al. ..... 271/242

* cited by examiner

*Primary Examiner*—Patrick Mackey

(57) ABSTRACT

An apparatus for processing, stacking and thereafter collecting printed forms, includes: a dual registering stacking interface, that stacks and accumulates forms in a stack or in a continuing feeding as separate forms; and, a sequencer merger that receives the forms from the dual registering stacking interface and directs the forms in a selected order to an output end. The output end communicates with an accumulator that feeds the forms to a folder. The folder thereafter feeds the forms to a collector to be held until called for by a subsequent downstream device, such as a mail inserter device. The register, accumulator and collector are belt and/or roller driven devices, wherein the invention provides clutching assemblies for the transport belts and rollers in order to eliminate the streaking of the printed forms when idled forms are held stationary against the transport belts.

2 Claims, 21 Drawing Sheets

Fig. 2
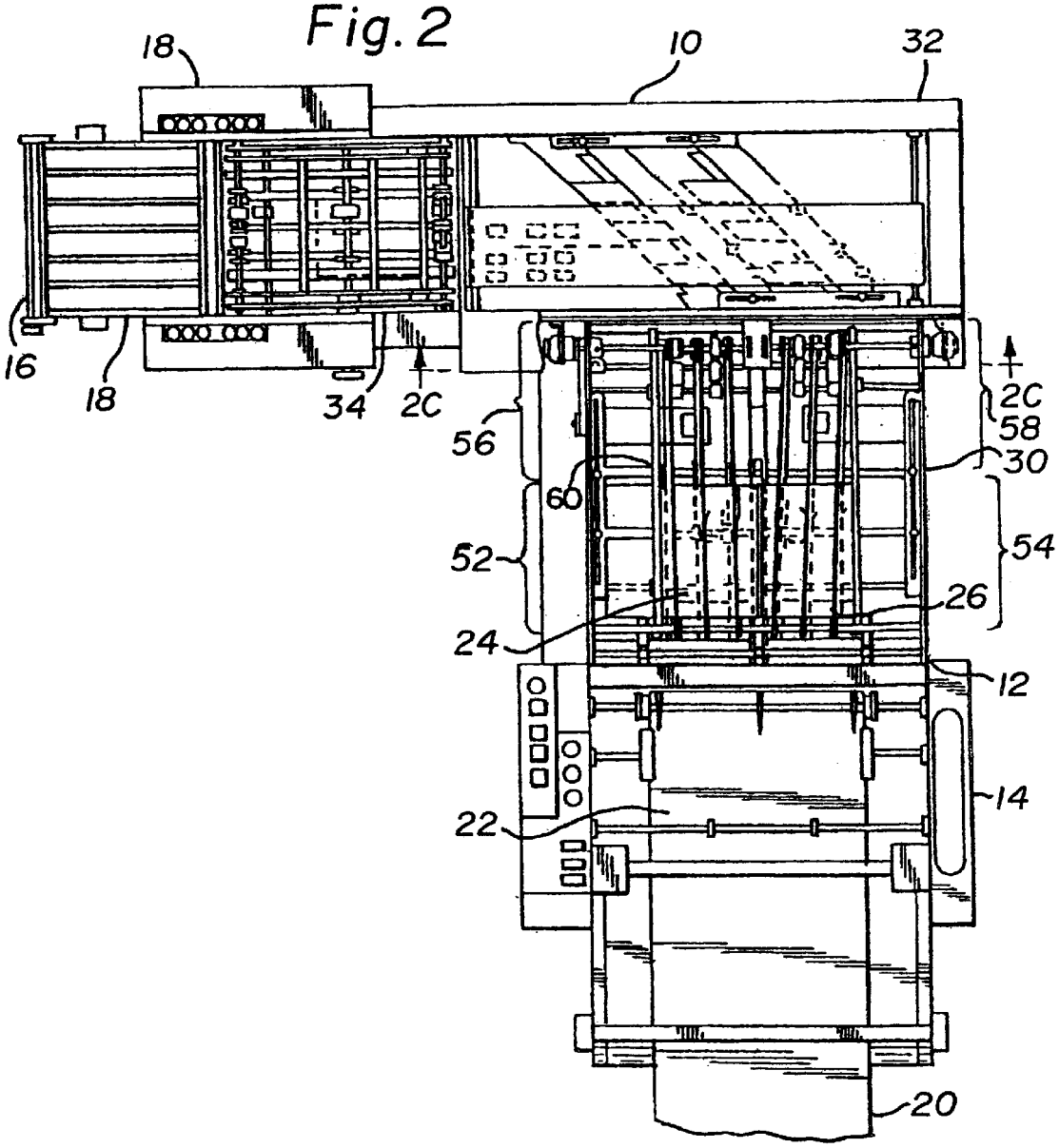
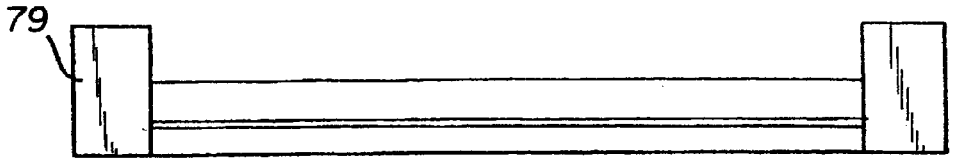
Fig. 2C

Fig. 2A
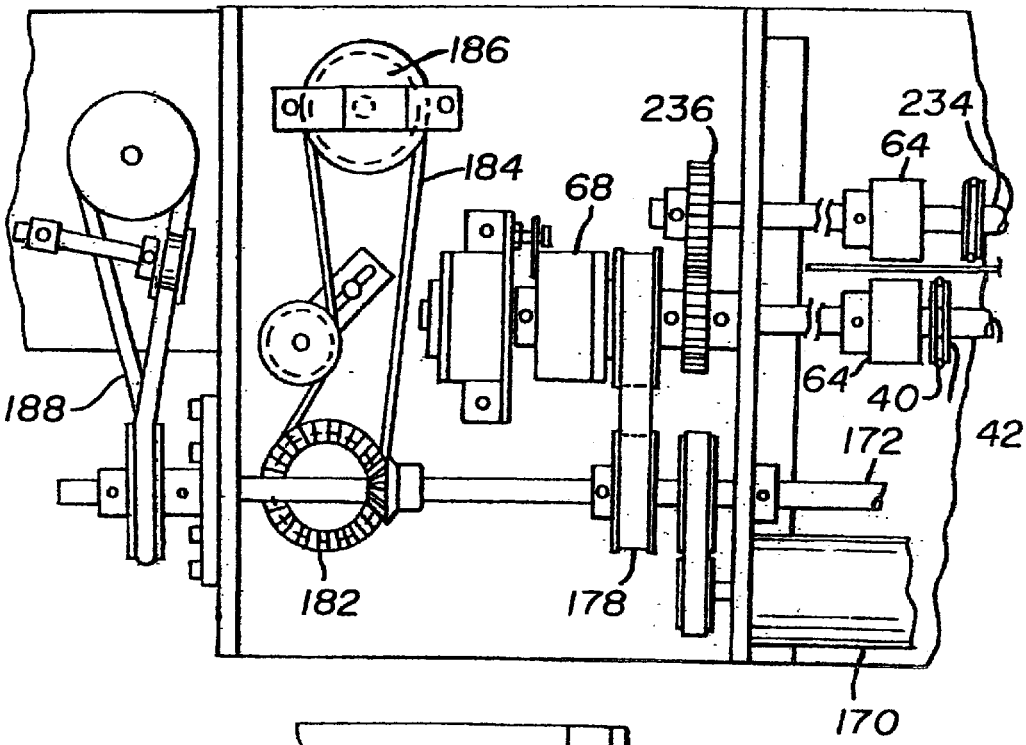
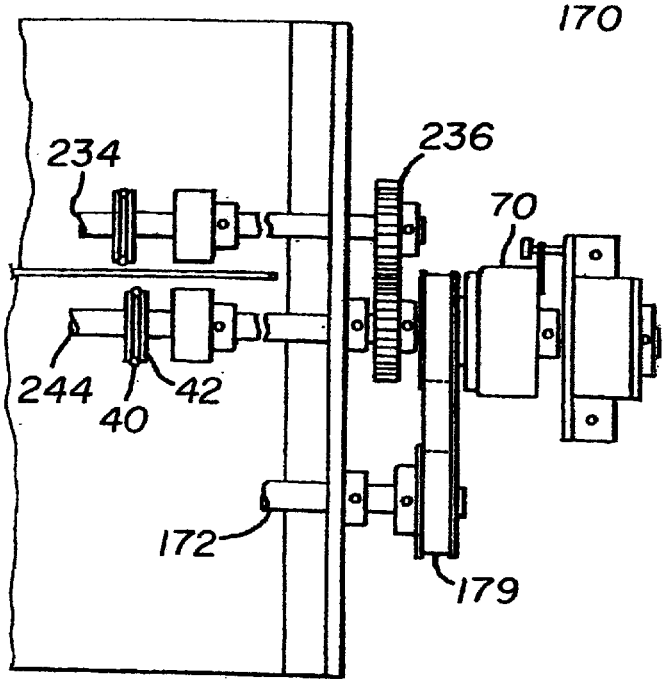
Fig. 2B 306
305
306
312
304
302
311
303

306
305
306
313
310
302
312
303
304

204
202
192
194
60
190
200
196
198

204
192
202
60
190
194
200
196
198

309
302
304
303
307
310
311
312
310
308

Fig. 27
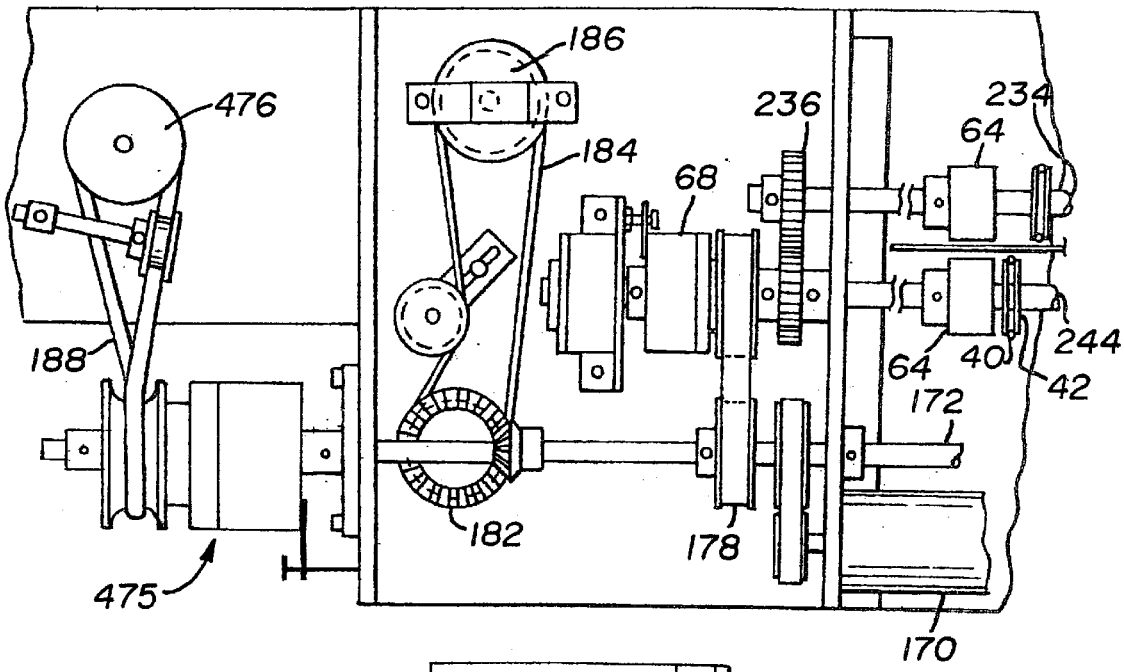
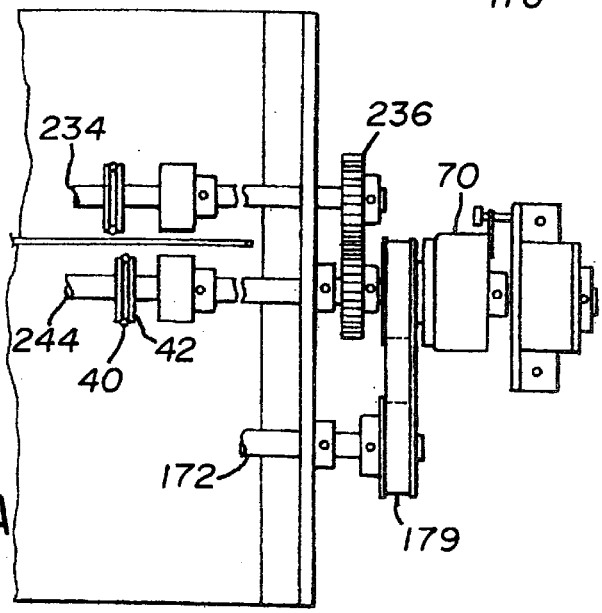
Fig. 27A

STREAK FREE APPARATUS FOR PROCESSING AND STACKING PRINTED FORMS

RELATED APPLICATIONS

The present application is a divisional application of U.S. Ser. No. 09/777,334, filed Feb. 6, 2001, Now U.S. Pat. No. 6,592,114.

BACKGROUND OF THE INVENTION

The invention relates to a method of and apparatus for handling both preprinted and unprinted forms without streaking of the printing when handling printed forms. Forms which are preprinted and coded in certain machine or human readable formats may be taken from a bulk stack or roll of forms and automatically processed. Unprinted forms can be processed using preprogrammed steps.

The processing operations may include combinations of stacking, sequencing, merging, accumulating, restacking, folding, collecting, and then loading into a high speed mail insertion machine. The invention can be operated both in line—with an inserter—or off line for testing or other operations such as sequencing and stacking for folding. The stacked, folded forms can then be handled manually or preferably fed to an inserter machine. These can also be programmed in a preset automatic non-optical mode that does not rely on optical marks for control.

The invention in U.S. Pat. No. 5,867,864 has advantages in a combination of its flexibility in handling alternative form printing formats such as last page first, mixed multiple and independent sequencing and stacking, as well as keeping track of multiple page and variable page sets while also providing greatly improved speed of operation to enable maximizing the speed of the high speed mail insertion machinery.

Prior to the invention described in said patent, previous feeding and transporting mechanisms required major mechanical and electronic changes to efficiently process a variety of form sizes and formats and printing sequence formats. Most prior art devices have no provisions for under or over stacking while running a side-by-side form. In addition, most prior art devices make no provision to stack, right and/or left justify and deliver up to two channels of paper side-by-side, independently of each other, with precise superimposition of the stack.

As described above, there are a variety of formats for printing of documents that arrive to the envelope inserter facility in the form of the continuous form web. For a variety of reasons, a web is printed at the convenience of the company whose statements or mailings go to mail recipients. Often this is a company such as a credit card company sending credit card bills or a bank sending mortgage statements or the like.

Very often, the preprinted webs of continuous feed forms are delivered to a mailing house that processes and mails all the documents with the capital, facilities and expertise to do so with greater efficiency than the credit card companies or banks. However to serve different credit card companies, banks or the like, it is necessary for the mailing house to tailor its operations to process whatever format their customers, i.e., the different credit card companies, banks, or the like, use. Since different credit card companies, banks or the like often print in different formats, flexibility in processing formats is important to the efficiency of the mailing house. Similarly, even the mailer, who does the envelope insertion, itself may want to have flexibility in the event it changes its printing program or uses different printing programs.

Formats such as "one up" printing, where a single page is processed are fairly easy to feed into an envelope inserter such as that taught in U.S. Pat. No. 1,738,119 and later embodiments generally known as machines of the Phillipsburg type. For documents fed "two up", typically side by side, it is necessary to use a merger so that a plurality of document streams or channels result in a single channel. A typical approach is that taught U.S. Pat. No. 4,273,319. Another approach is in U.S. Pat. No. 4,572,497. Still another is taught in U.S. Pat. No. 4,456,127.

West/East printing starts with a left channel, the next page to the same recipient in the right channel, the third page back to the left channel, but, of course behind the first page. This sequence, zig-zagging back and forth, is repeated for the selected number of recipients and pages. When there are the same number of pages for every recipient, the format is called "West/East multiple." Where there is a different number of pages for every recipient, the format is called "West/East mixed multiple." If the right channel has the first page and the left channel the second, the analogous terminology to that above would be used to describe "East/West" formats. Typically, documents fed in West/East or East/West are accumulated in a stack in an accumulator and then the set is injected to a folder and thence to the inserter. However, the arrangements prior to the invention of U.S. Pat. No. 5,887,864 for typical inserter feed apparatus were unable to handle North/South multiple formats. North/South mixed multiple format and the operation of the invention will be discussed in detail and with reference to schematic drawings.

Thus, the convention in the high speed printing and the subsequent high speed mail handling field is to refer to printing operations as "East/West" where related forms such as a credit card bill of multiple pages that go to the same addressee, are printed, at least in part, side by side, and "North/South" where related forms are printed end to end or top to bottom. Another convention is to refer to form printing and subsequent high speed mail handling as "one up" where a single page is printed and all subsequent pages follow in one continuous feed batch, and "two up" where two pages are printed side by side and enter the high speed mail handling equipment's first step (usually a cutter) in a side by side manner. It is the forms, as printed, which determine whether the batch is arranged "East/West", West/East, "North/South".

When forms are printed that have different number of pages per set they are referred to as mixed multiple forms. While these may be printed either "East/West" or "North/South," because of the mixed number of multiple pages, it is critical to control both channels to be sure sets are processed correctly. East/West or West/East mixed multiple forms use both left and right channels to process one particular form, effectively zig-zagging from one channel to the other. North/South mixed multiples have all the pages for one form in one channel, but both channels must be controlled to be sure multiple forms from one channel are not processed out of order relative to the other channel.

A one-up continuous form is a continuous web of paper used for creating documents in a continuous stream allowing only one document for the width of the form. Each consecutive document appears in a subsequent pattern and continue along the length of the web.

A two-up continuous form is a continuous web of paper used for creating documents in a continuous stream allowing two documents to be printed side-by-side restricted by the width of the form. This form is generally slit vertically down the center to separate the documents and then trimmed to width on the sides.

North/South printing sequence format is a process by which a one-up or two-up continuous form is used, printing one document or two documents side-by-side. Of course, by definition one up forms have to be North/South because there is no East/West relationship.

East/West printing sequence is the process by which a two-up continuous form is used for printing two documents side-by-side on a continuous web. In East/West, when a multiple page statement is required, the first page of the set can appear in channel one or channel two (left or right). The next page of that same set would appear in the next position using a left to right, top to bottom theory of collation. Therefore, if there was a three page set and page one of that set appeared in channel two, the second page appeared in channel one, one position down from the first page and the last page of that set would also appear in channel two, one position down from the first page. The convention used herein will use West/East by analogy to the cardinal points of a compass where North refers to the leading edge of the sheet. Thus. West/East refers to side by side pages with the left page first, while East/West refers to side by side pages with the right page first.

The dual registering stacking interface or "register" described herein enables an effective method of processing cut forms originating from a stacked continuous web of paper and flexibility in processing all of the required printing sequence formats.

Two separate forms are delivered side-by-side and enter the register. The separate forms are fed into first and second parallel staging areas respectively. While the forms are in these staging areas optical characters previously read on the forms are processed and the forms composed for delivery to the stacking area. Optionally, appropriate reader apparatus could be incorporated with the register.

Moving to the stacking area, where multiple page sets are involved, the pages are stacked respectively separately and progressively right and left justified prior to releasing to a subsequent device—the sequencer-merger. The pages are also lead edge justified and become superimposed.

Where single pages are involved, the dual registering stacking interface functions as a North/South area enabling timing for sequencing. Justification remains important for maximum speed and the control provided enables better sequencing.

A key to this operation is the processing of the optical reading to determine the relatedness of forms in selected combinations of North/South series or East/West relationship. Thus, the processing of the optical reading will determine the need for collation, the need for incorporating related pages into sets such as in East/West mixed multiple forms, the sequencing of sets or simply the sequencing of single page printed forms. Even in this last operation, control is desirable where, for example the printing in Zip code order proceeds with the left hand ("West") form first or the right hand ("East") form first. The apparatus described herein can control West/East forms as well as East/West forms.

It should be recognized, however that the apparatus described herein can also be used in a preprogrammed sequence and/or set collation without using reading. Examples of this operation would be where there is so little variation in the forms that sequencing need not be automated, or even where the apparatus is used for a purpose other than mailing such as sequencing and feeding hand deliverable materials to a folder and to a collector in an off line manner.

In the preferred embodiment, appropriate automatic actuator controls will signal whether, for example, a second page in one channel relates to the immediately prior sheet (now in the stacking area). If related, the two will be stacked. If not, then each sheet will be injected to the next step.

The sheet or stack is released and moved from the stacking area after a predetermined number of forms have accumulated in said stack. Each channel's moving mechanism includes upper and lower transport belts transversely offset from each other which are in different vertically adjacent planes to cause the belts to grasp and move the forms forward. These belts are also in different horizontally adjacent planes.

Preferably each set of belts for a given channel are horizontally angled to the outside as paper travels to the right on channel two, to the left on channel one. This causes a sheet and consecutive forms to be accumulated and right or left justified and are neatly stacked prior to release from the stacking area in either channel. At a minimum one set, preferably the outer set, would be angled.

Each stacking area is located between a sheet recording mechanism to record the number of forms passing through and a pair of spring loaded compliant rollers. The rollers stop the paper stack from moving forward, align said stack perpendicular and square with the next device and eject said stack to a subsequent process. Stacking is assisted by low friction sheaves through which the belts pass, but which enable subsequent forms to pass under earlier forms maintained in the North/South area. Generally the friction of the belts prevents any rebounding of the forms. There is no rear stop needed.

In order to accomplish registering, the present invention provides implementation of the transversely offset upper and lower belts and with their driven rollers horizontally offset and adjusted about five degrees offset from their drive rollers toward the right or left side of the device for right or left justification, stacking and superimposing. The angle is variable for maximum performance with different forms, paper, speeds and the like and has been effective between about one degree to about ten degrees. A separate left hand and right hand clutch/brake control is provided for each left and right channel for independent or simultaneous release to a subsequent process.

The dual registering stacking interface is adaptable to selectively handle the following different combinations of form layouts: one-up continuous form; a two-up continuous form; East/West printing sequence format and North/South printing sequence format, left channel first or right channel first.

Collation in the North/South printing sequence format mode is done in the register stacking area(s) and before sequencing. In the East/West format collation of sets is done in the accumulator/collector after sequencing.

In North/South when a multiple page document is required, the first page of the set will appear in the first position on a one-up form and each consecutive page thereafter. In a two-up form, the first page can appear in either of two side-by-side channels and each consecutive page will appear in the next position after its previous page using a top to bottom theory of collation for either of the two channels.

The dual registering stacking interface or register positively registers the forms outwardly against rails as they pass from a staging area to a stacking area. The previously read coding is processed and the stacking controlled so that the desired collation is accomplished. This can, for example, be simply West/East programming where each of two related papers which travel side-by-side are intended to be collated and to be ultimately inserted together in a single envelope to a single customer. West/East forms feed into the sequencer/merger are fairly easy to control because the forms are in the proper order when they enter the sequencer/merger and thence enter the access accumulator.

The use of the register in conjunction with the other steps described herein also enable highly complex collation and sequencing such as North/South mixed multiple stacking as where the identity between sequential papers is on a North/South basis but not all customers receive the same number of pages in their mailing. Thus, with two pages in the registered area and two pages in the stacking area, three separate customers may be represented. The North/East customer may get a single page, the North/West customer may get two pages comprising the North/West page and the south/west page, while the South/East page is for yet a third customer.

The stacking mechanism in conjunction with the optical reader and control will then inject stacks in the proper order into the sequencer merger.

The sequencer merger includes deflector guides fixed at both ends which both invert and rotate each stack. They are inverted 180 degrees (180) vertically and rotated 90 degrees (90) horizontally in the preferred embodiment. From here, the now sequenced stacks are injected into a transport or subsequent device such as an one up stacking register which performs a task of counting and controlling each individual stack. When an online one up stacking register is used, for example, it then injects each stack in the proper order into a folder, then to a collector, and thence into the high speed mail inserting machine. The ability to change the timing or release of the forms will enable the forms to be fed in a non-merged or separate manner where desired.

The stacking register disclosed herein can be used for one-up operation as well as for two-up operations. As with the dual registering stacking interface the one to ten (preferably five) degree angle side justifies the forms.

A problem in such apparatus is the streaking of ink on the printed forms when even momentarily in contact with moving transport belts, such as at the register, accumulator and collector. The problem stems mainly from the use of constantly moving belts or rollers that are in contact with a stationary printed document. Because of the desire to keep the paper handling drive mechanisms simple and flexible, most of the known mailing machine manufacturers tend to leave the transport belts running all the time. This method is also an effective means to handle the bounce back when a paper form is stopped at high speeds. An effective transport using this method is really a compromise between providing enough friction to transport the paper in a controlled and repeatable manner, but not so much as to overcome the stopping or holding mechanism. Normally, the short amount of time that the paper is actually stationary is not sufficient to cause a streaking problem. However, since the register, sequencer, accumulator, folder and collector are slave devices to the inserting machine, any delays or stoppages in that process lead to increased idle time with the belts still running. Paper idle times of more than only about a half second can cause streaking. The degree of the problem is related to the melting temperature of the toner used to create the images, the density of the print, and the quality of the fusing process in laser printers typically used to print the forms. Today's high-speed laser printers seem to be more susceptible to the streaking problem. This is probably due to the toner chemistry, as well as marketing demands for true high density black images.

OBJECTS OF THE INVENTION

It is a primary object of the invention to prevent streaking of printed forms caused by constantly moving belts or rollers contacting a stationary printed document at any of the register, accumulator or collector devices.

It is a further goal to prevent such streaking for both one or two sided printed forms where the moving belt or roller contact is only for about one-half second or more.

Other and further objects of the invention will be apparent upon an understanding of the illustrative embodiment about to be described, or will be indicated in the appended claims and various advantages not referred to herein will occur to one skilled in the art upon employment of the invention in practice and the scope of the invention is not to be narrowed by these statements of objects.

BRIEF DESCRIPTION OF THE DRAWINGS

FIG. 2 is a plan view showing the general layout of the apparatus.

FIG. 2A is a partial elevational view showing the left side drive mechanism of the dual registering stacking interface.

FIG. 2B is a partial elevational view showing the right side drive mechanism of the dual registering stacking interface.

FIG. 2C is a sectional view through line 2 in FIG. 2 of the register showing the register plate and aperture therein.

FIG. 27 is a partial elevational view showing the left side drive mechanism of the dual registering stacking interface and the main drive motor and drive shaft, including the driving connection to the accumulator wherein the improvement is shown comprising the addition of a clutch and take-off pulley engaged to the main drive shaft for controlling operation of the accumulator drive pulley.

FIG. 27A is a partial elevational view showing the right side drive mechanism of the dual registering stacking interface.

DETAILED DESCRIPTION OF THE DRAWINGS

Figure 1:
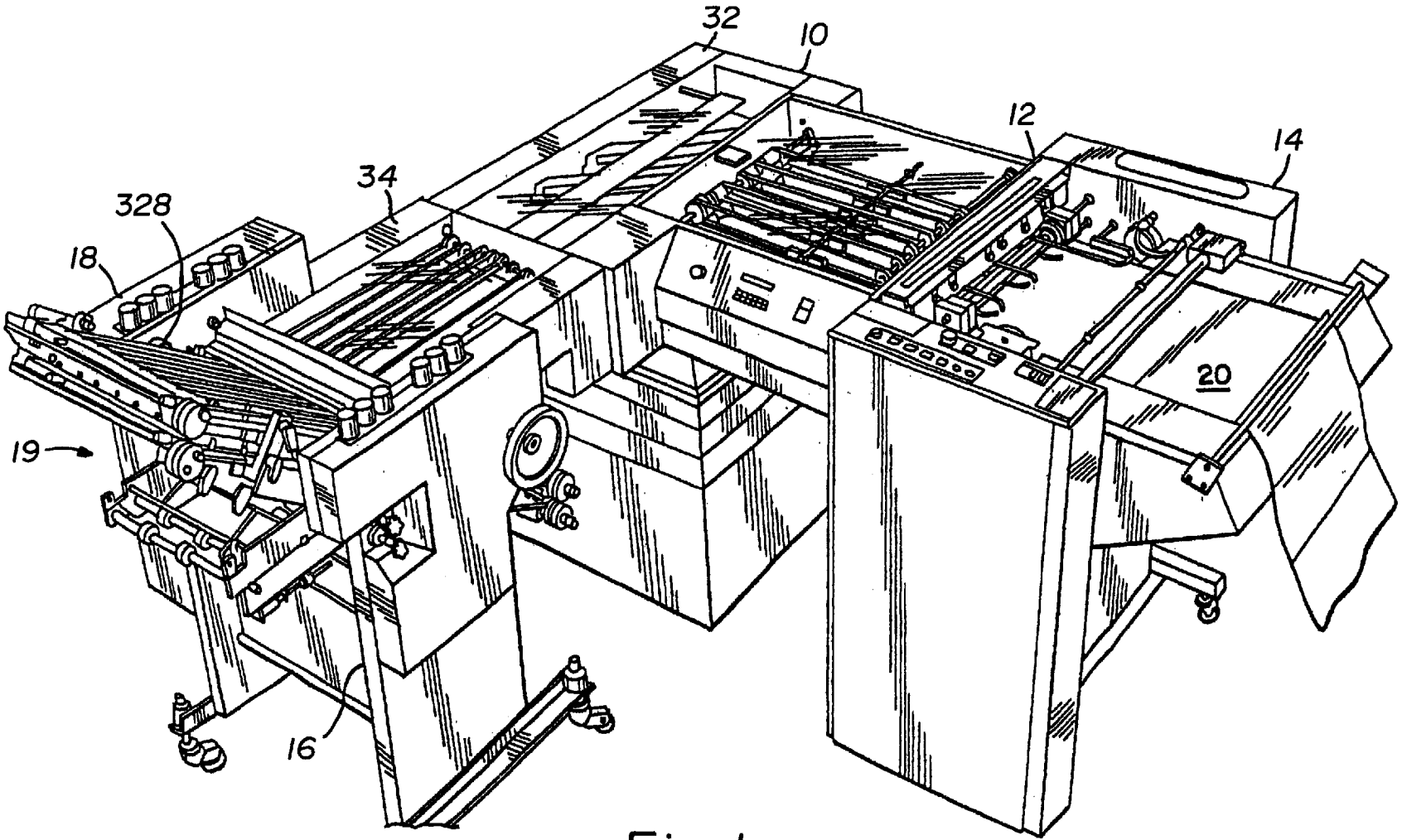
FIG. 1 is a perspective view showing the general layout of the apparatus.

The invention provides a streak-free modification to a printed form handling assembly 10 having an input end 12 receive cut forms from a cutter 14 and delivering as sequenced form sets at an output end 16 having a folder 18 dispensing folded sets to a collector 19.

In operation, a stacked or roll fed continuous web 20 of preprinted forms feeds into forms cutter 14. An individual form feed web 22 will be cut into left form 24 and right page 26 as they feed into the forms cutter 14. From forms cutter 14 the cut pages 24 and 26 are injected into dual registering stacking interface 30.

The key components in this apparatus are a dual registering stacking interface or register 30, a high speed sequencer merger 32, an access accumulator 34, a folder 18, and a collector 19.

Referring to FIGS. 2A, 2B, 6B, 11 and 12 the transport assembly of the dual registering stacking interface 30 has a number of lower belts 40 activated by lower pulleys 42 and a number of cooperating upper belts 44 activated by upper pulleys 46 which are transversely offset from the lower pulleys and also angularly offset relative to the longitudinal axis of each paper path.

Web 20 cut into individual pages 24 and 26 enter left channels 48 and right channel 50 respectively between upper and lower belts 40, 44. Pages 24, 26 then move into staging areas 52 and 54 waiting for a command signal to allow the input device to release said paper to be transported to stacking areas 56 and 58. As paper travels from staging areas 52 and 54 to stacking areas 56 and 58 it is transported outboard and left and right justified towards left hand side guides 60 and right hand side guides 62. Due to the lower and upper transport belts of both channels being horizontally offset to the outside and toward guides 60 and 62 due to the lower and upper transport belts of both channels being horizontally offset to the outside and toward guides 60 and 62. This allows for a left or right justified stack occurring in stacking areas 56 and 58. Additional pages will follow, stacking on the previous pages right or left justified against side guides or rails 60 and 62 neatly stacked and superimposed square to output rollers 64 and 66. Prior to release to a subsequent device, paper is now stacked in each stacking area 56, 58 up to a predetermined number at the time the control system decides which channel to move, and at what time.

FIGS. 19–24 illustrate the way the apparatus can process North/South Mixed Multiple format documents with great speed and efficiency. While prior to U.S. Pat. No. 5,887,864 other document format combinations had been capable of being processed at high speeds primarily using a single accumulator as the stacking apparatus, such as West/East and East/West in multiple and mixed multiple arrangements, and North/South in fixed number sets, the processing of North/South format documents, when in sets of mixed numbers, e.g. one set with two pages, the next with three pages, the next with a single page, had been problematic. This is because a set with a fewer number of pages would finish before a set with a greater number in passing through to the sequencer/merger thereby throwing the pages of following sets out of order.

Figure 19:
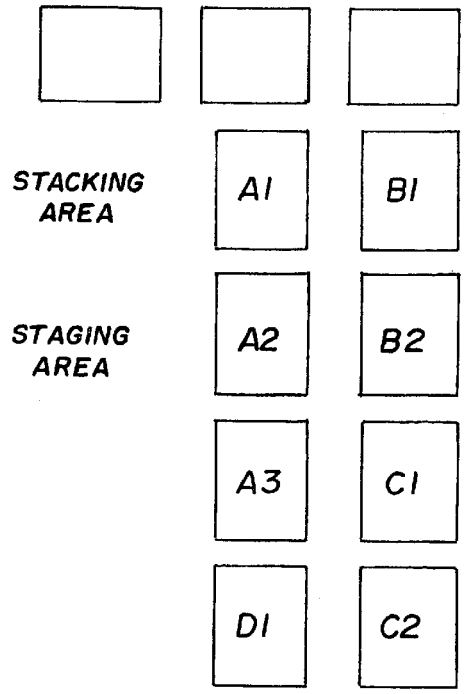
FIG. 19 schematically illustrates North/South mixed multiple printed documents at a first stage.

FIGS. 19–24 illustrate a method of processing printed papers in a schematic form. The left channel 48 and right channel 50 feed into registering or staging areas 52 and 54 stacking areas 56 and 58. In these schematics the letter designations "A", "B", "C" and the like have been used to designate associated sets, such as credit card bills to be mailed to one addressee, while the numbers following the letters designate the page number. Thus, the three pages of papers coded to addressee "A" are pages A1, A2 and A3, the two pages to addressee "B" are pages B1 and B2 and the like. FIG. 19 begins at the time that the first form enter stacking areas 56 and 58.

Figure 20:
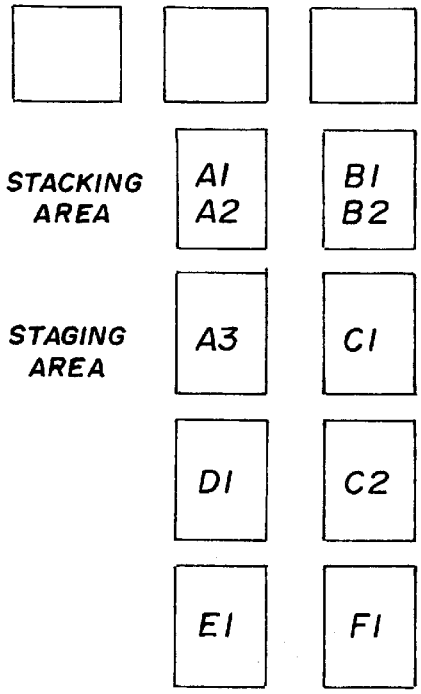
FIG. 20 schematically illustrates North/South mixed multiple printed documents at a second stage.

In FIG. 20 both the A and B sets are being stacked in areas 56 and 58. These are represented by the convention of showing the alphanumeric designations A1 over A2 and B1 over B2, respectively, which convention will be used for the other sets as well. Since the B set has fewer pages than the A set, it is completed first and moves out of area 58 into sequencer/merger in FIG. 21.

Figure 21:
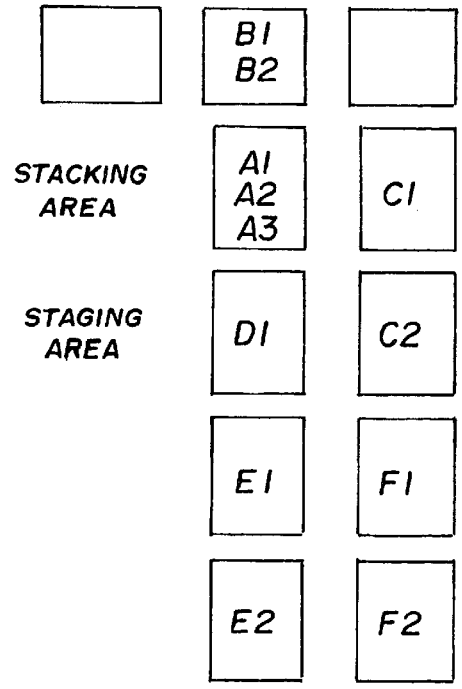
FIG. 21 schematically illustrates North/South mixed multiple printed documents at a third stage.

In FIG. 21, the A set has three pages, and is still stacking in area 56 while the B set, having only two pages has already passed into the sequencer/merger. If there were no stacking in the register, both forms sets would be passing into the sequencer merger, thereby potentially commingling the B set, completed ahead of the A set, with the A set which has three pages.

Figure 22:
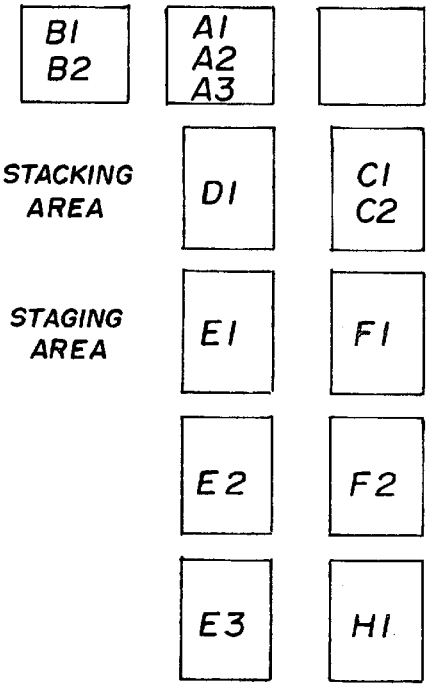
FIG. 22 schematically illustrates North/South mixed multiple printed documents at a fourth stage.

FIG. 22 shows that when set A is complete, is not yet released to the sequencer/merger because the B set needs to pass completely through the sequencer/merger. Set B is shown as leading set A. This is anticipated in the printing operation, not a part of this invention, so that, for example, the sets are printed to be collated and processed in the correct zip code order.

The precise timing, in fractions of seconds, is indicated by the arrows in FIGS. 21–24 in the schematic, there being sufficient lag to anticipate set B accumulating as shown in FIG. 22. In FIG. 22, it may be seen that set C has completed stacking and is moving out of area 58.

Figure 23:
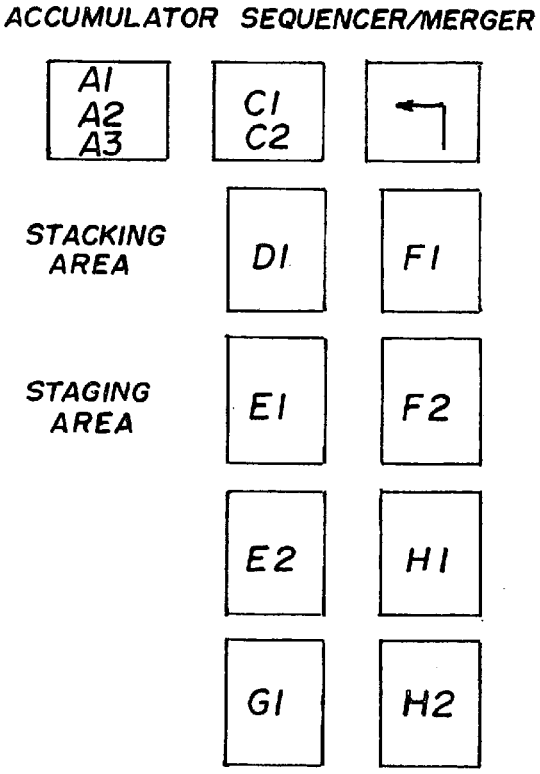
FIG. 23 schematically illustrates North/South mixed multiple printed documents at a fifth stage.
Figure 24:
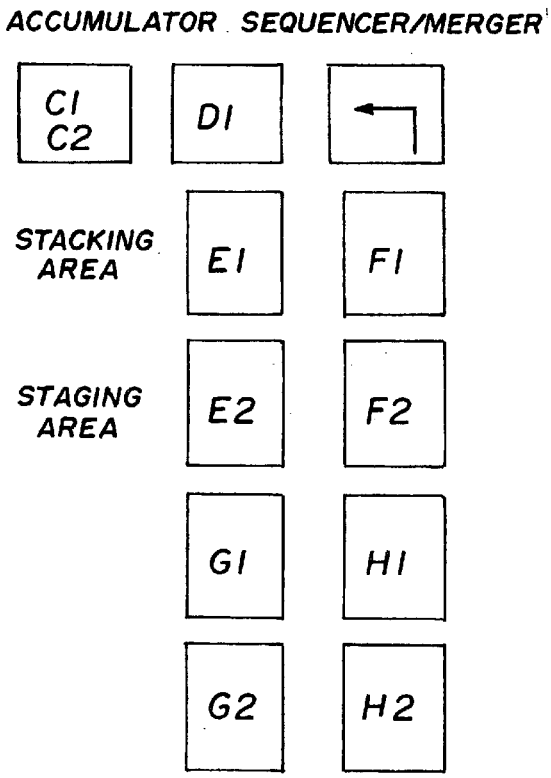
FIG. 24 schematically illustrates North/South mixed multiple printed documents at a sixth stage.

FIG. 23 shows set A, now complete, passing into the sequencer/merger. Set C is also released into the first position in the sequencer/merger. One page set D has been held in stacking area 56 and will do so until set C clears the sequencer merger in FIG. 24 to enable set D to pass through in future steps. The ability to control the release of channels 48 or 50 to the sequencer/merger is therefore a key to this operation.

Preferably, North/South fixed number multiples are also stacked in areas 56, 58. While prior to the invention disclosed in U.S. Pat. No. 5,887,864, North/South single pages could be done with known prior art register tables and the register tables could be used for all West/East and East/West combinations, the register tables could not perform the North/South multiple operations.

Since both left and right channels are independent of each other, moving either channel of paper can be accomplished at one time, clutch and brake assemblies 68 and 70 are used to rotate the output rollers or feed wheels 64, 66 and which in turn will move the stacked paper into the next device.

The angled offset of the belts 40, 44 justifying the paper outwardly against side guides or rails 60, 62 provides great speed and accuracy. Previously known high speed form cutters were not sufficiently accurate so that all paper widths were within particularly close tolerances. Using the outward justification therefore was a major improvement provided in said patent.

Figure 3:
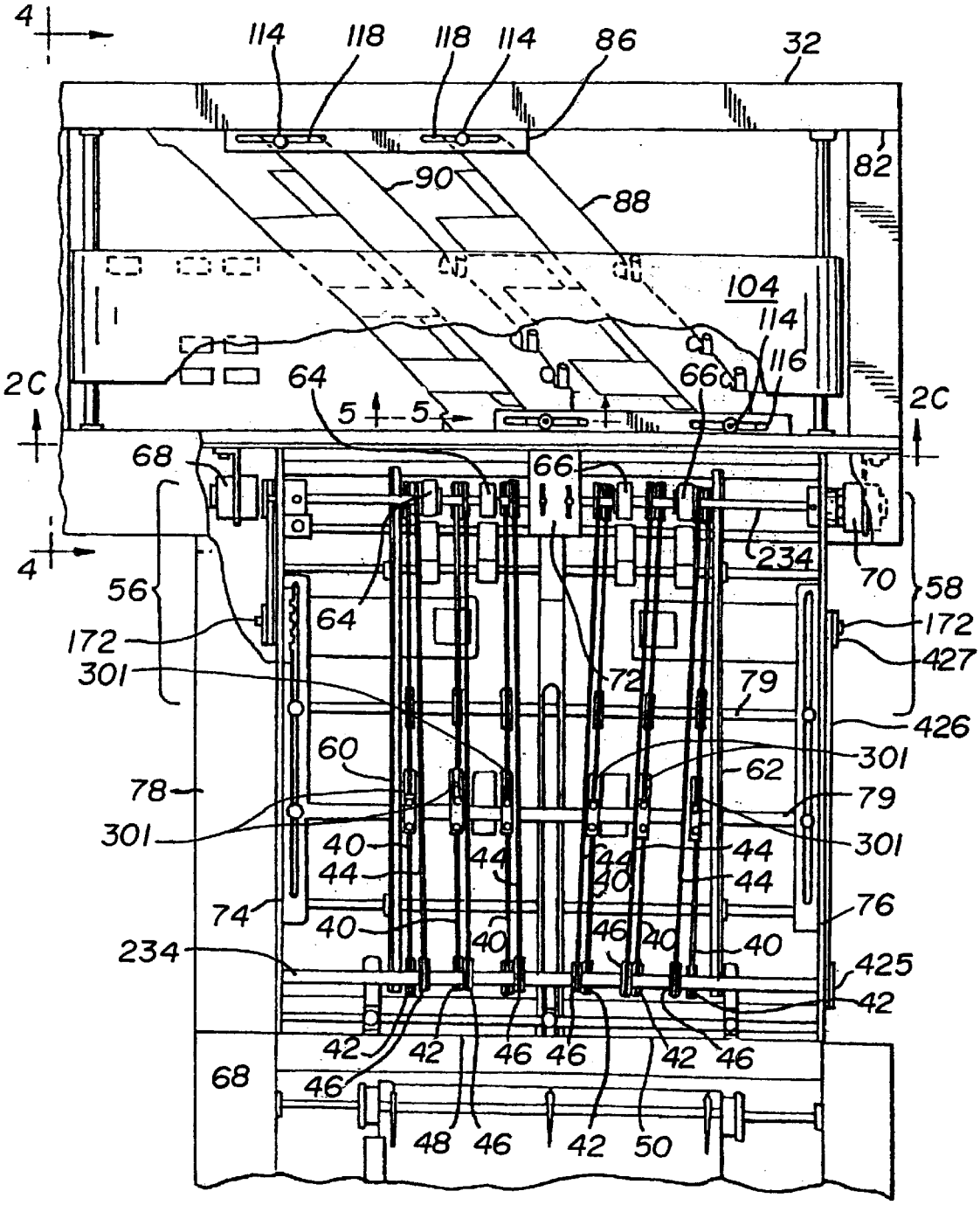
FIG. 3 is a plan view of the sequencer merger and dual registering stacking interface with the sequencer belt partially cutaway.
Figure 4:
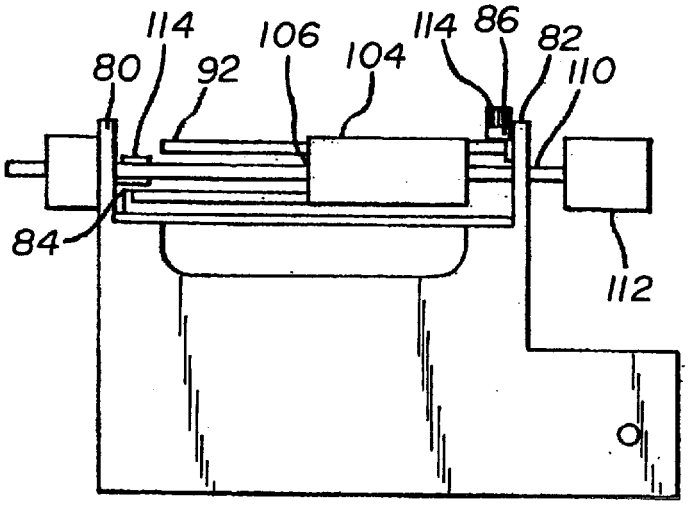
FIG. 4 is a rear elevational view of the sequencer meager.
Figure 5:
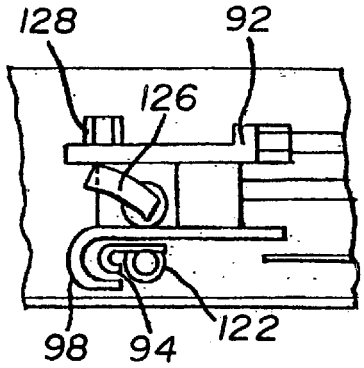
FIG. 5 is a sectional view of the sequencer merger.

Sequencer merger 32 is shown in FIGS. 3–5. Side plates 80 and 82 support a generally box-like structure. Angle supports 84, 86 support tube assemblies 88 and 90. An aperture is formed in plate 80 to permit passage of paper forms from register 30 which is mounted to plate 80.

Tube assemblies 88, 90 are made up a crosspiece 92, inner tube section 94 spacers 96 and outer tube section 98. Each tube section 96, 98 has a respective extending flange 100, 102 which receive a form 24 or 26 ejected from register 30 and turns it 180 degrees vertically—turning in "upside down" in the preferred embodiment.

Because tube assemblies 88, 90 are angled 45 degrees to the direction of ejection from register 30, the forms are also rotated 90 degrees horizontally. Belt 104 driven by drum 106 on drive shaft 110 by motor 112 carry forms longitudinally to the access accumulator, or accumulator 34, at the exit end of the sequencer merger 32.

Mounting screws 114 firmly hold assemblies 88, 90 to supports 84, 86 enabling precise adjustment thereby improving reliability at high speeds of operation. Adjustment slots 116, 118 permit fine tuning of the angle of assemblies 88, 90. Slot 118 can preferably be adapted to have a slightly wider slot than that on support 84 to permit both skew adjustment and longitudinal adjustment of tube assemblies 88 and 90.

These sequencer/merger tube assemblies 88, 90 are particularly useful in handling forms that may be injected to the sequencer/merger 32 from the register 30 in a stacked condition.

Figure 6A:
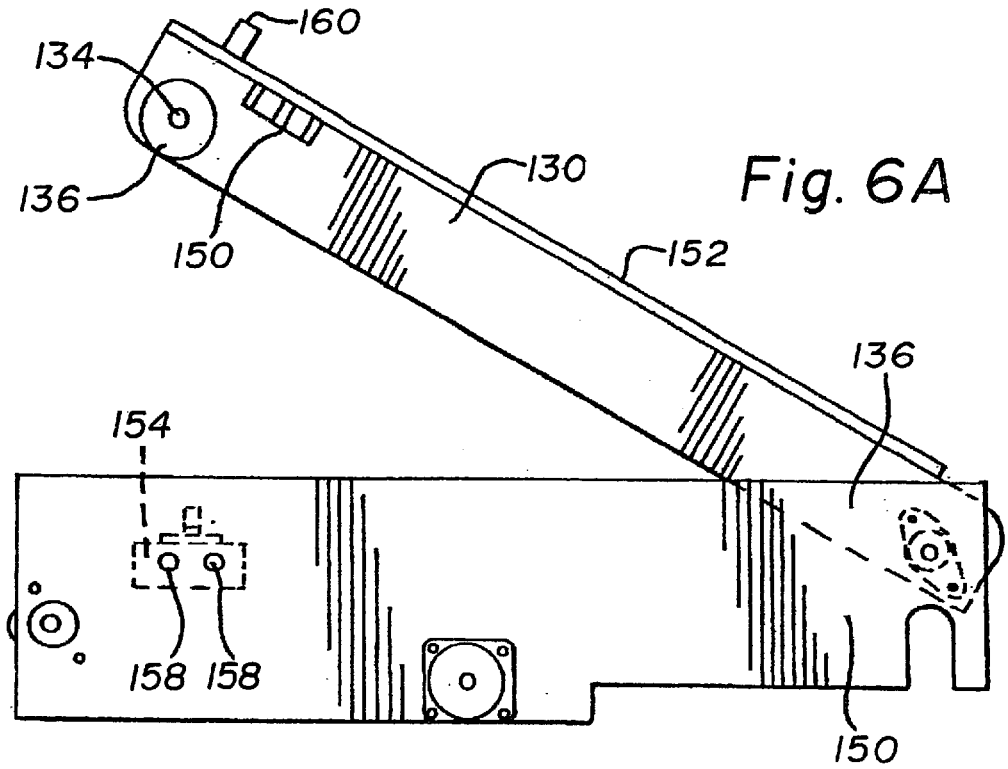
FIG. 6A is a side elevational view of the access accumulator.
Figure 6:
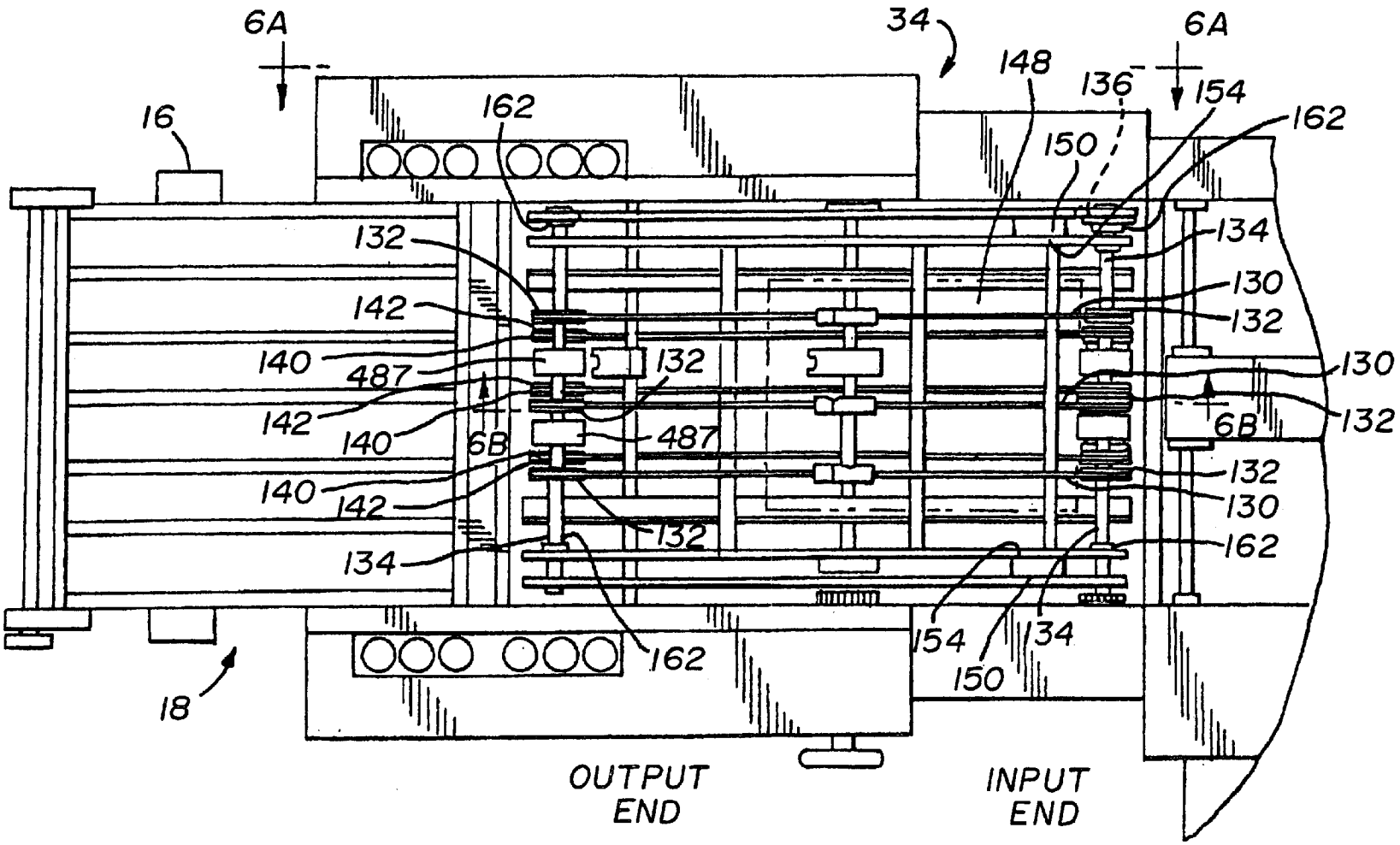
FIG. 6 is a plan view of the access accumulator.
Figure 6B:
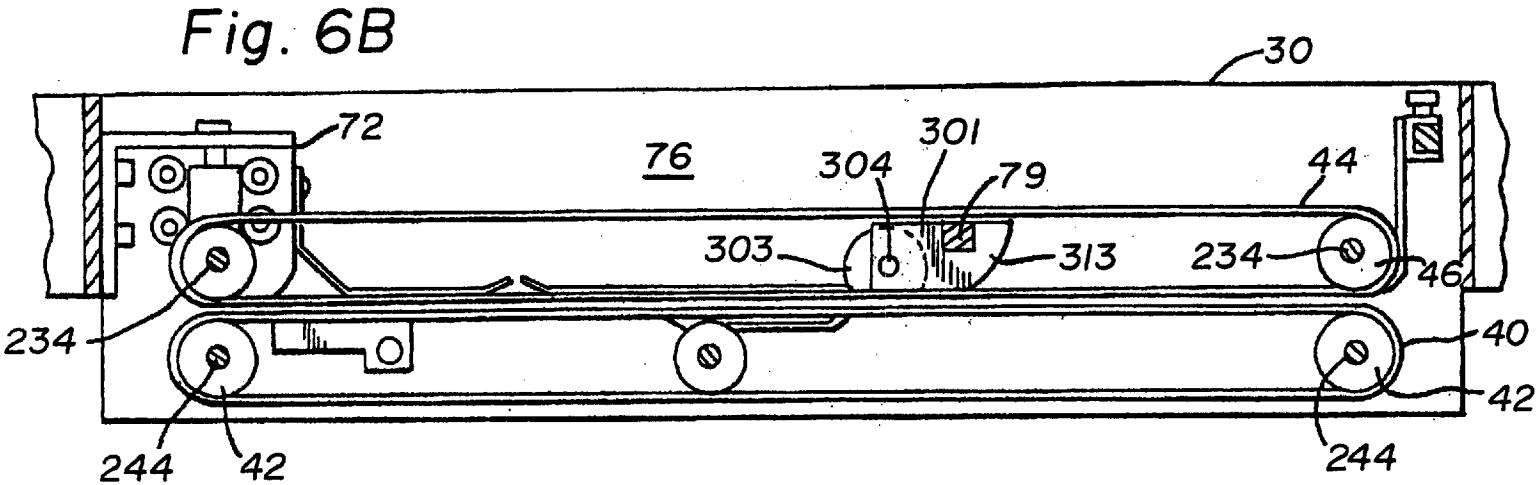
FIG. 6B is a sectional view of the dual registering stacking interface.
Figure 7:
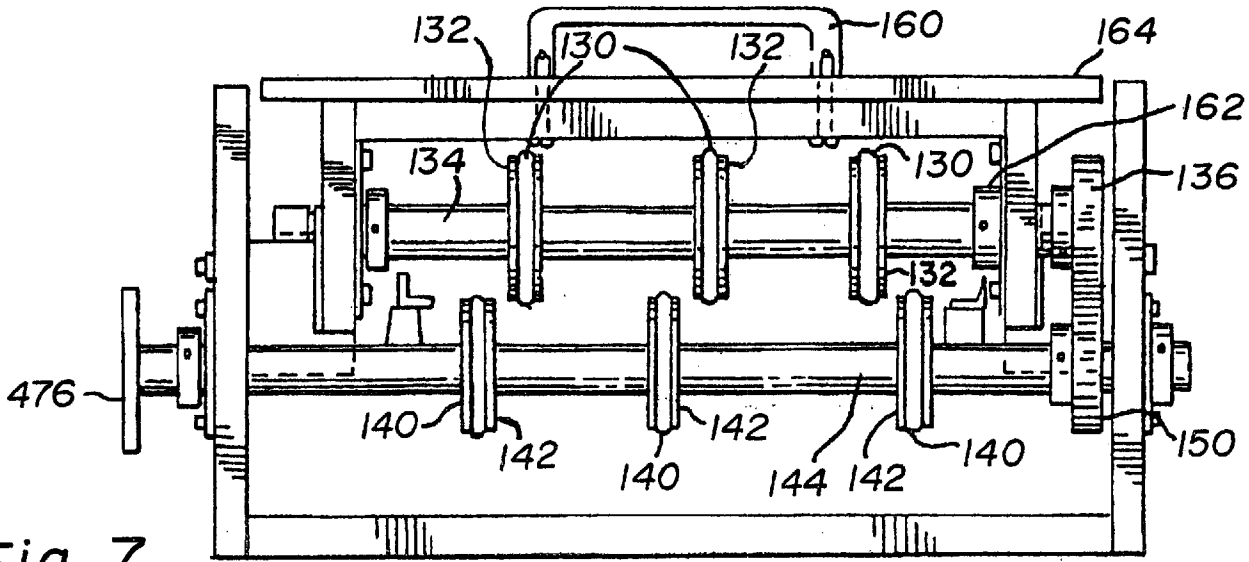
FIG. 7 is an end view of the access accumulator showing alignment blocks and latches and relationship of top transport belts to lower transports belts.
Figures 8, 9, 10, 13, 14:
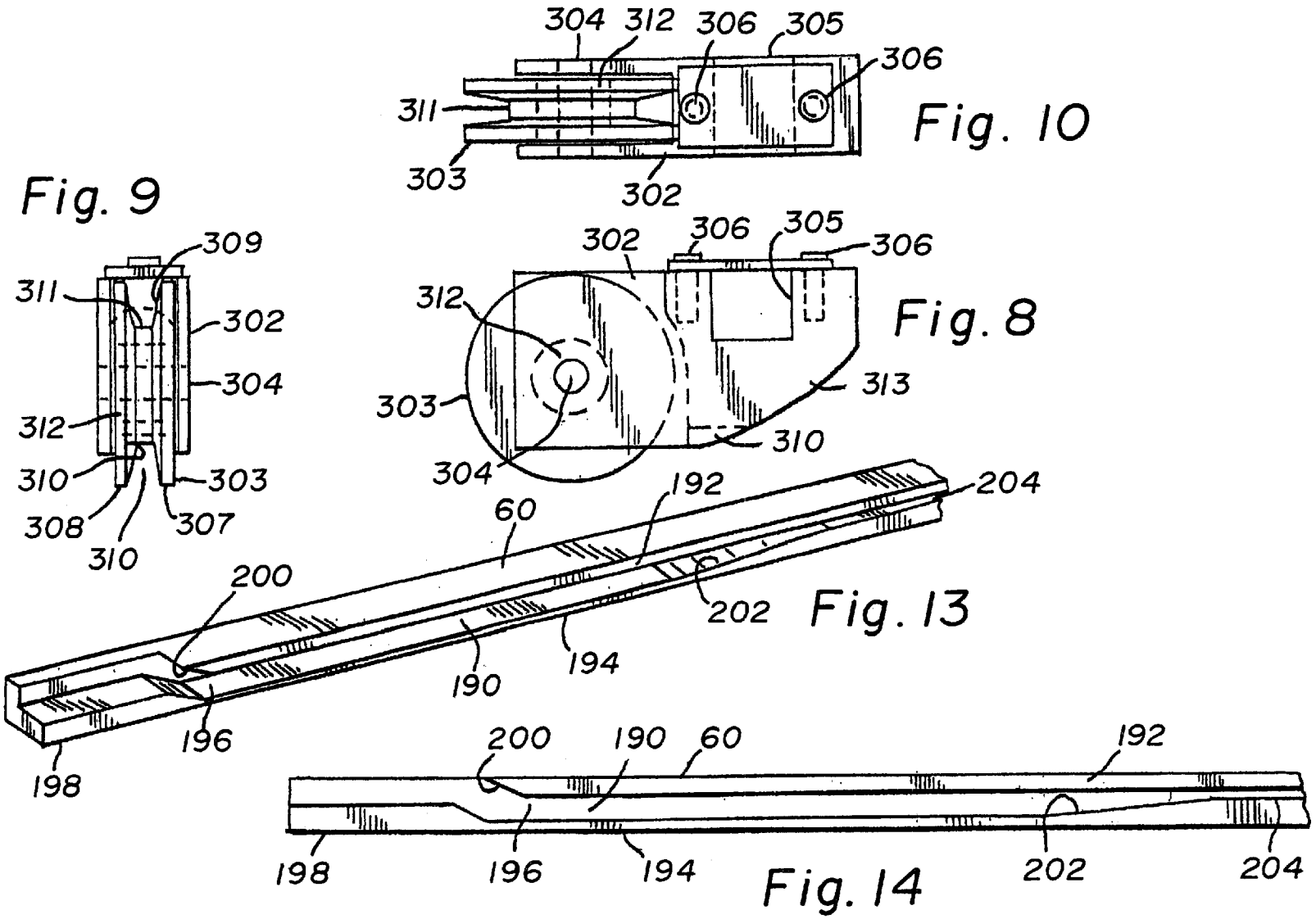
FIG. 8 is a elevation of a low friction paper guide.
FIG. 9 is a front elevation of a low friction paper guide.
FIG. 10 is a bottom plan view of a low friction paper guide.
FIG. 13 is a perspective view of a rail for the dual registering stacking interface.
FIG. 14 is a right side elevational view of the rail for the dual registering stacking interface.
Figure 11:
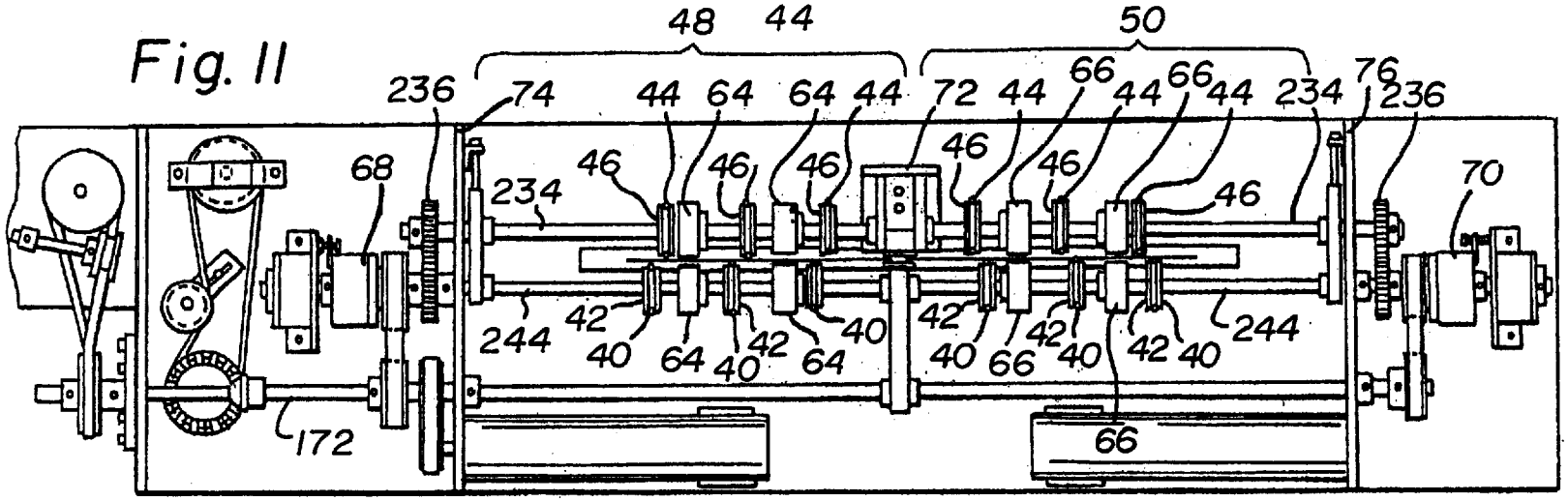
FIG. 11 is a front elevational view of the dual registering stacking interface.
Figure 12:
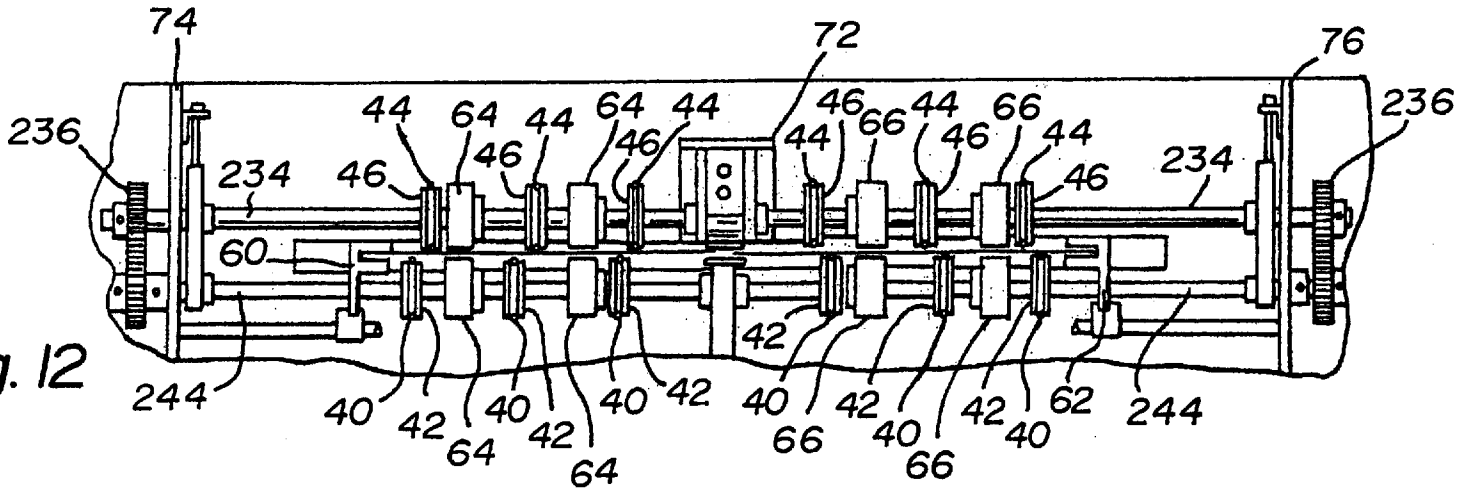
FIG. 12 is a rear elevational view of the dual registering stacking interface.
Figure 15:
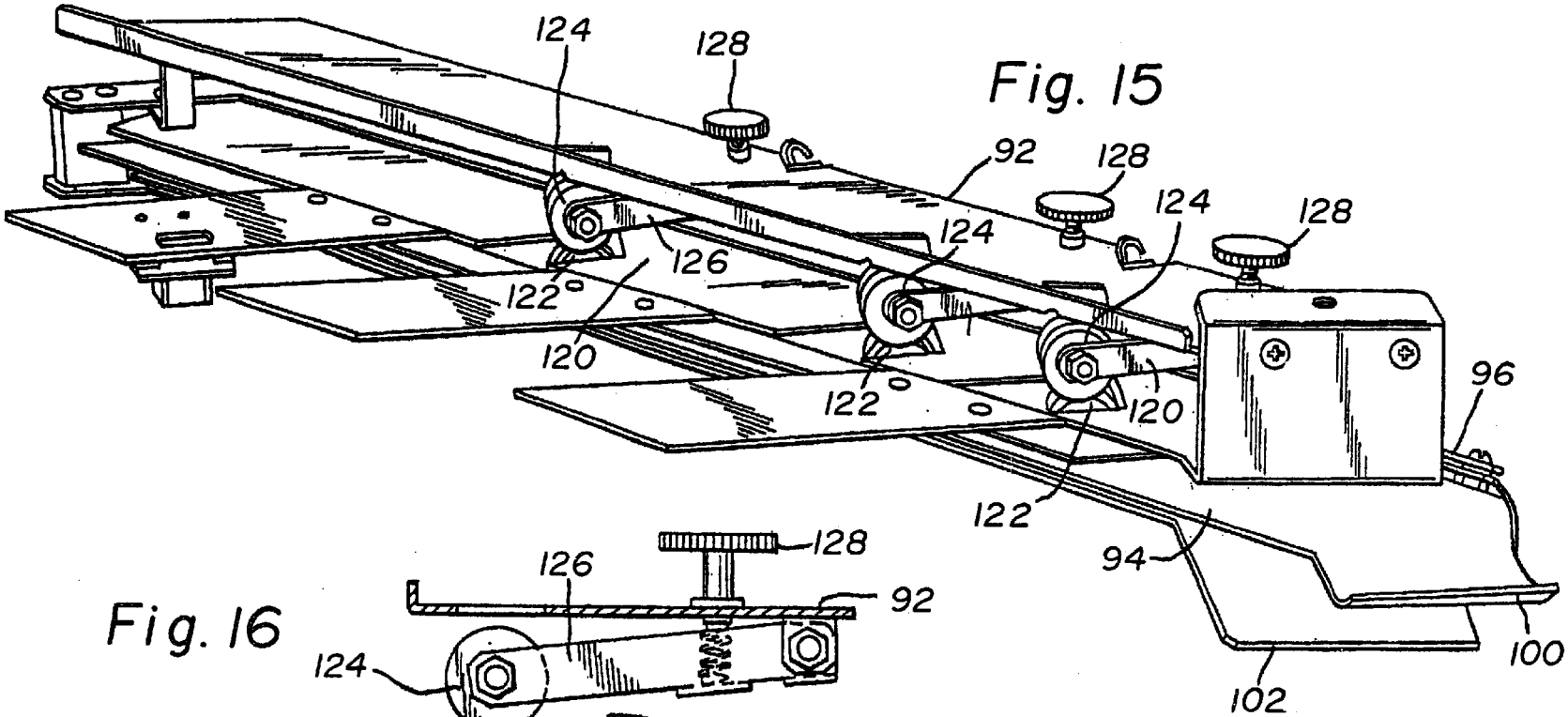
FIG. 15 is a perspective view of a tube assembly.
Figure 16:
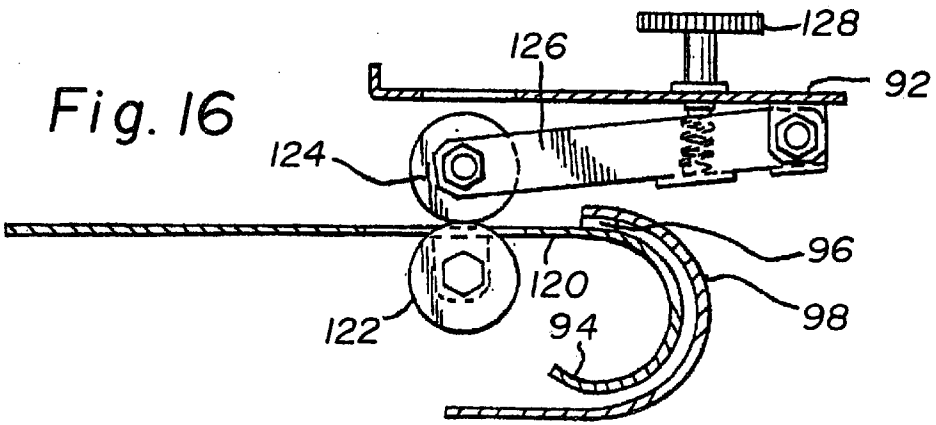
FIG. 16 is a cross-sectional view of a tube assembly.
Figure 17:
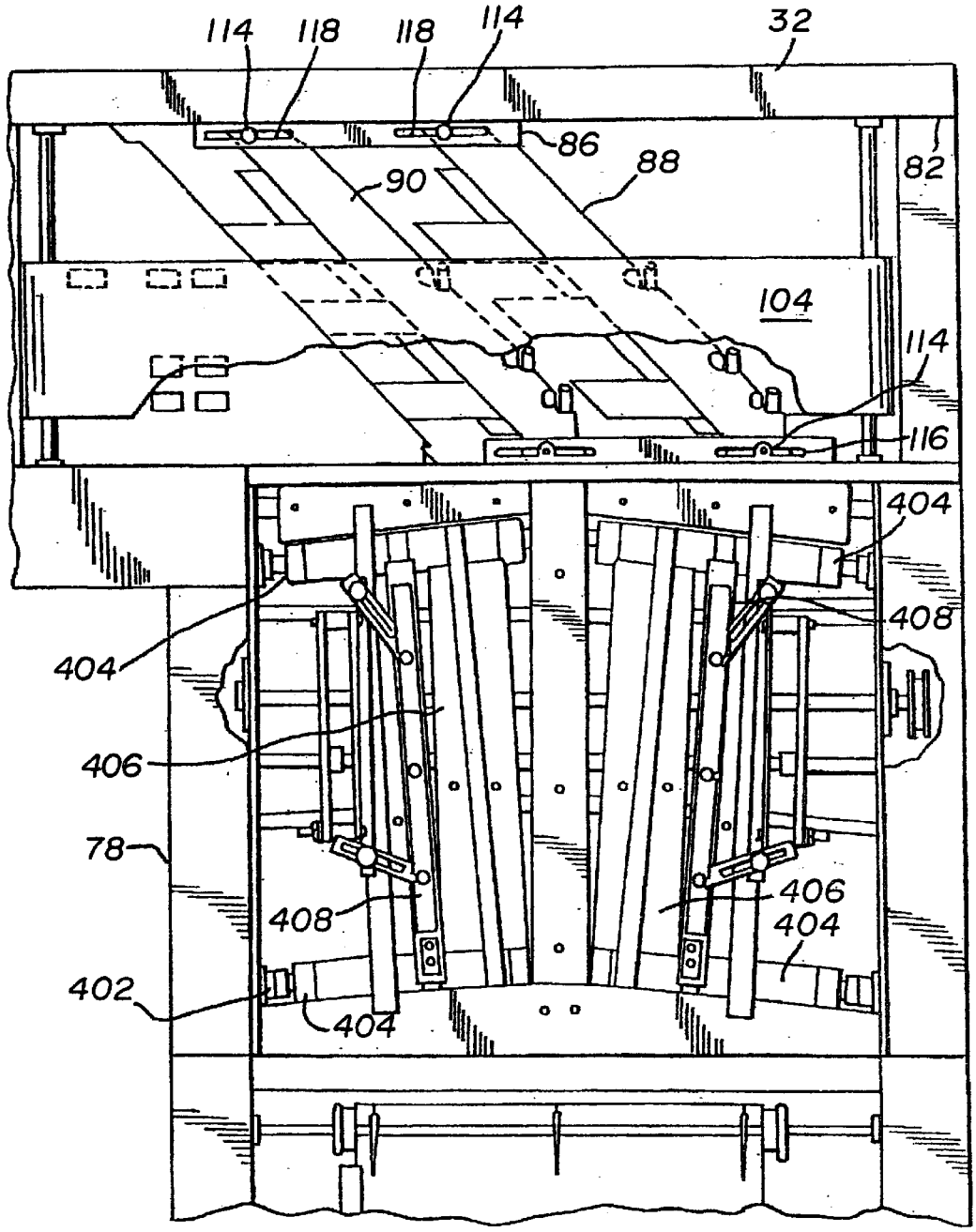
FIG. 17 shows an alternative embodiment using a portion of the mechanism of a prior art register table adapted to be used with the components of the invention.

Referring to FIGS. 6 and 7, the sequenced forms enter the improved access accumulator 34. Upper belts 130 driven by upper pulleys 132 driven by upper shaft 134 are driven by way of upper drive shaft drive gear train 136. Lower-belts 140 driven by lower pulleys 142 are driven by lower drive shaft 144. Thereby the paper is transported to final stacking area 148. The upper and lower shafts at the output end include output end pinch rollers 487 for feeding the stacked forms to the folder 18. Since the access accumulator 34 allows for more than one single sheet of paper to pass into the access accumulator 34 at one time, latches 150 are spring loaded to allow upper transport assembly 152 to adjust it-self up and down depending on the thickness of the paper stack. A left hand and right hand alignment block 154 are provided for adjustment of upper transport assembly as it relates to the lower drive shaft 144 and its respective parts. As shown in FIG. 6A, the upper drive gear 136 and lower drive gear 150 are separated when the upper transport assembly 152 is lifted, then remesh as in FIG. 7, when upper transport assembly 152 is set back in place.

The alignment blocks are adjusted via screws 158 for lateral and horizontal adjustments. A handle 160 is provided to assist in lifting the upper transport assembly 152 up to service the mechanism such as to clear jammed paper and to perform other adjustments. Bearings 162 are sealed, self-aligning clamping style. Similar bearings, sized for the greater loads on the shafts on the register 30. A shield 164 preferably of a strong plastic such as Lexan is provided for cleanliness, operational improvement and safety reasons.

Referring to FIGS. 1, 2–3, 11 and 12, moving from the cutter 14 the two-up forms enter the register 30. Two individually controllable channels 48 and 50 are provided. Upper belts 44 are driven by upper pulleys 46 which are themselves driven by upper shafts 234.

Lower belts 40 are moved by pulleys 42, themselves driven by drive shafts 244 via belt 178 and main drive shaft 172. In this way forms 24 and 26 in each channel 48, 50 are transported to final stacking areas 56, 58. Shafts 234, 244 are driven together at the output end of the register 30, by way of left and right drive shaft gear trains 236. In said U.S. Pat. No. 5,887,864, the upper shaft 234 at the input (opposite) end is continuously driven by the drive shaft 172 via a belt 426 joining a fixed shaft pulley 425 mounted to drive shaft pulley 427. A lower shaft 244 at the input end (not shown) is also continuously driven by the drive shaft 172 via a shaft gear train like gear trains 236.

Injecting of forms 24, 26 from stacking area 56, 58 is controlled by independently clutched output rollers 64 and output rollers 66 for the separate channels 48 and 50. Each set of output rollers 64 and 66 has its own respective clutch and brake assembly 68 and 70. Effectively these disengage from gear train 236 so that forms 24, 26 remain in areas 56, 58 until release for injection into sequencer merger 32 is calculated to be called for. To this end, assemblies 68 and 70 are preferably computer controlled for such factors as optically read codes, form length, time, number of pages per set and set printing format so that all the subsequent steps are performed in proper order. In particular, the controlled assemblies 68 and 70 can be used for all the aforementioned combinations of North/South, West/East and East/West printing, in whatever multiples needed.

Center bearing assembly 72 allows independent adjustments and separation of drives for channels 48 and 50. The register is supported by side plates 74, 76 which enable the mechanism to be mounted in and demounted from housing 78 and provide the requisite support for cross members 79.

The drive arrangement for all three components, register 30, sequencer 32 and access accumulator 34 is shown in FIG. 2A and the clutch 70 for the register 30 in FIG. 2B. Motor 170 drives main drive shaft 172 which drives register shafts 234, 244 through timing belt 178 driving clutch 68 which selectively engages shaft 172 with gear train 236. Shaft 172 also drives gear train 182 which through belt 184 drives sequencer clutch 186. The left end of shaft 172 also drives access accumulator 34. A belt drive 188 is preferred. At the right side, in FIG. 2B, corresponding clutch 70 operates drive belt 179 and a right gear train 236 to maximize the precision of the timing of the belts to reduce the effect of torsion on the output end shafts, 234, 244.

As seen in FIGS. 6B and 8–10, low friction paper guide 301 is adapted to be usable in both the register and the access accumulator. Block 302 rotatably carries roller or sheave 303 on axle 304. Mounting recess 305 is provided in the top of block 302 for mounting to square section bar stock or the like in the unit in which it is to be mounted. Screw hole 306 is also adapted to aid in mounting and adjustment.

Sheave 303 has flanges 307 and 308 defining a groove 309 therebetween for receiving a selected drive belt. The drive belt also passes through slot 310 in the bottom of block 302. Flanges 307, 308 extend outwardly from a hub portion 311 thus the hub 311 defines the bottom of groove and the flanges 307, 308 the sides of the groove. In the preferred embodiment a bushing or bearing 312 is fitted to sheave 303.

Block 302 is formed to have a curved lead in portion 313 that directs form 24, 26 to roller or sheave 303 against the pressure of belt 40 or 44 depending on the upward or downward orientation of block 302. The use of the curved lead in portion 313 and sheave or roller 303 substantially reduces the friction on the form, permitting higher speed and fewer jams. It will also be noted that the free rolling of sheave 303 eliminates any rear stop effect as was used in the prior art.

Figure 18:
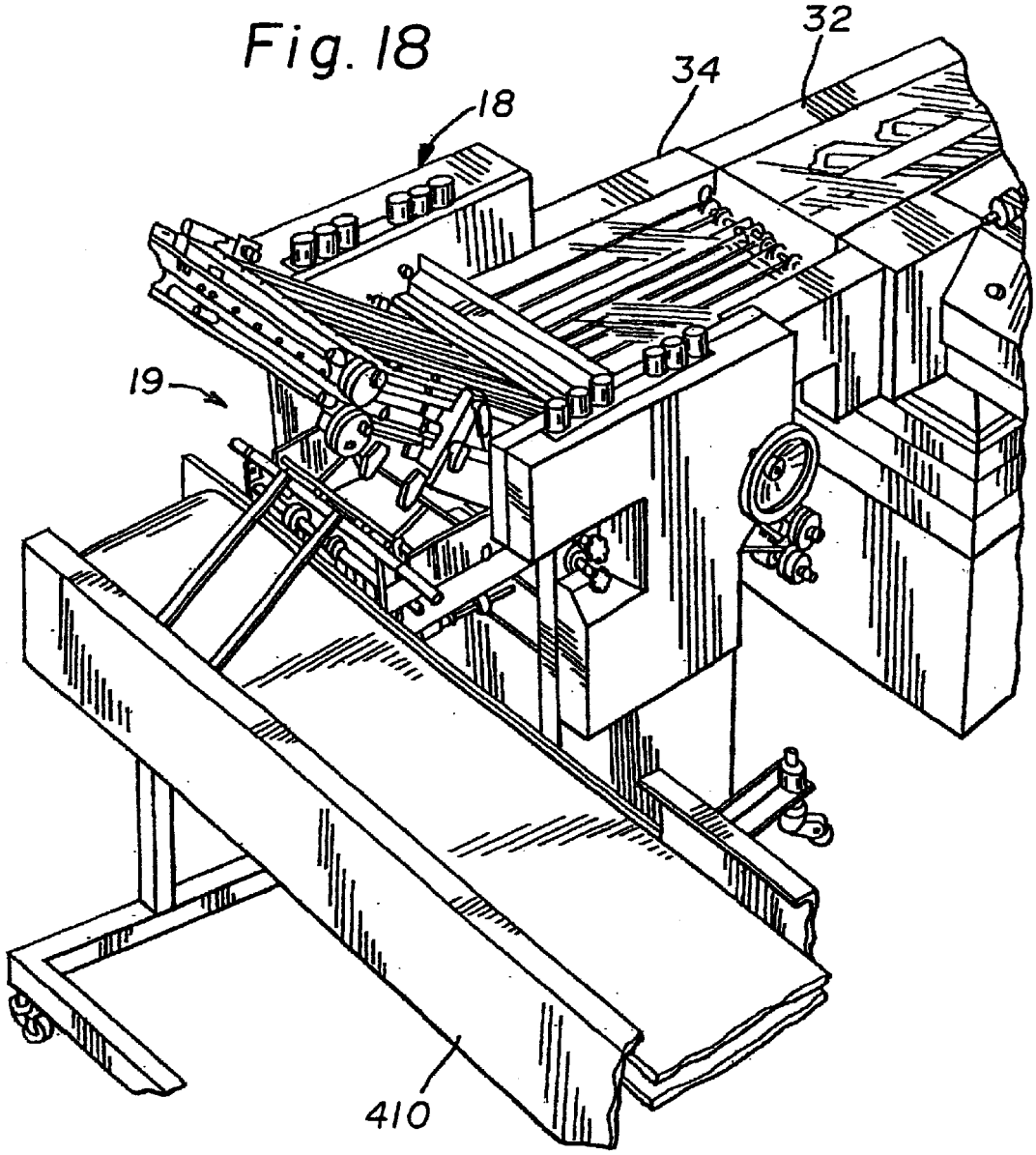
FIG. 18 illustrates the offline use of the invention where it is not connected to a cutter and envelope inserter.

FIG. 18 shows an off-line operation of the invention receiving forms from a collector 442 that is fed forms from the folder 18. The folder 18 is fed by the accumulator 34. Another advantage to the integrated control of register 30, sequencer/merger 32 and access accumulator 34 is that unlike prior art devices, the entire system can be disconnected from an inserter machine and used off line with or without the folder 18 or collector 19. This can be for testing, adjustment, set-up or maintenance, without requiring the operation of the inserter machine. This can also be advantageous for operations with an ancillary device 410 such as a simple conveyor receiving which would enable very rapid separation, collating, processing and folding of materials such as flyers or brochures to be distributed by hand or personally, such as a trade shows, conventions or the like.

Improved Register Paper Control

Figure 25:
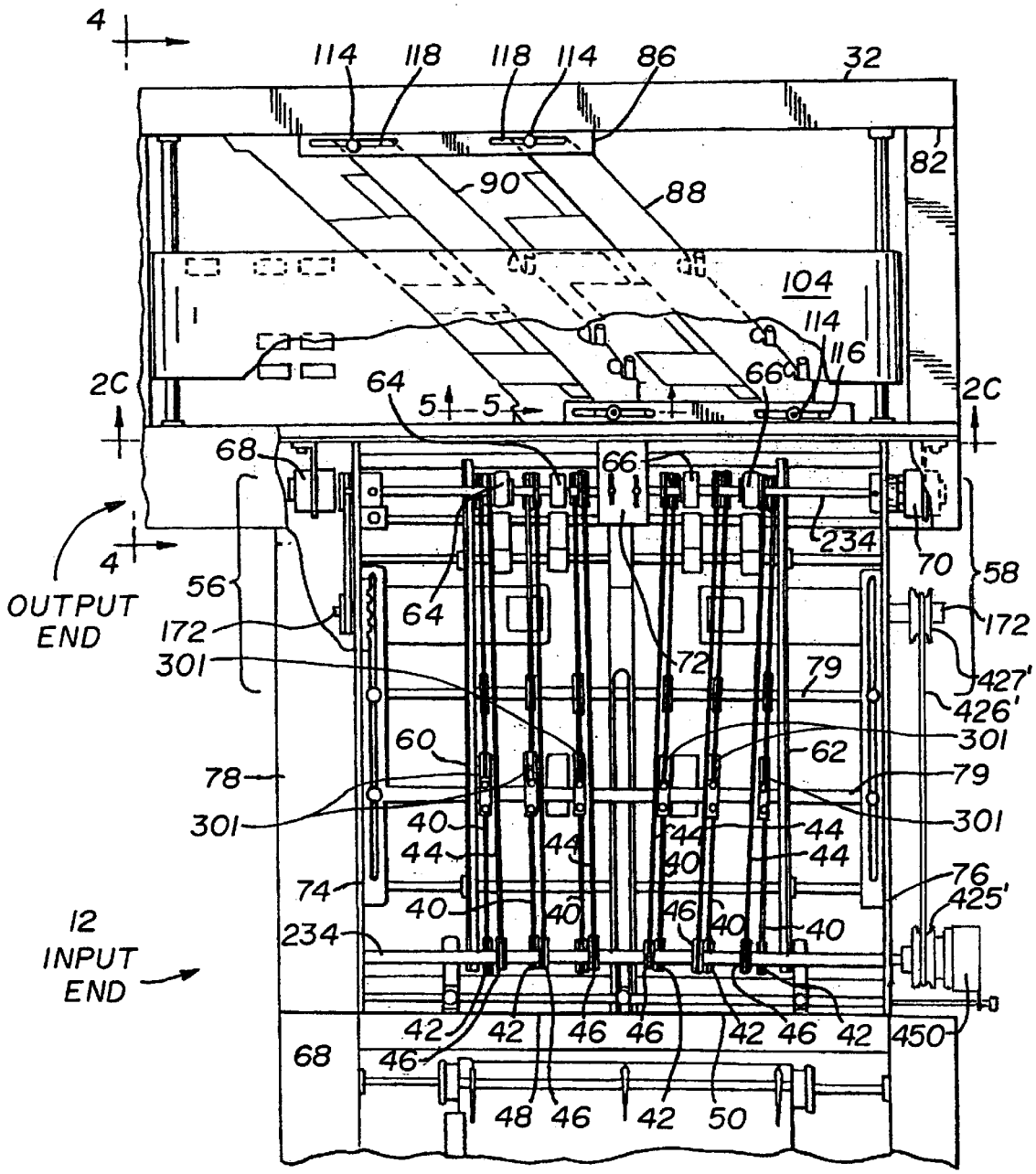
FIG. 25 is a plan view of the sequencer merger and dual registering stacking interface with the sequencer belt partially cut away and showing the streak-preventing register clutch for clutching the input end upper belt drive shaft pulley.
Figure 26:
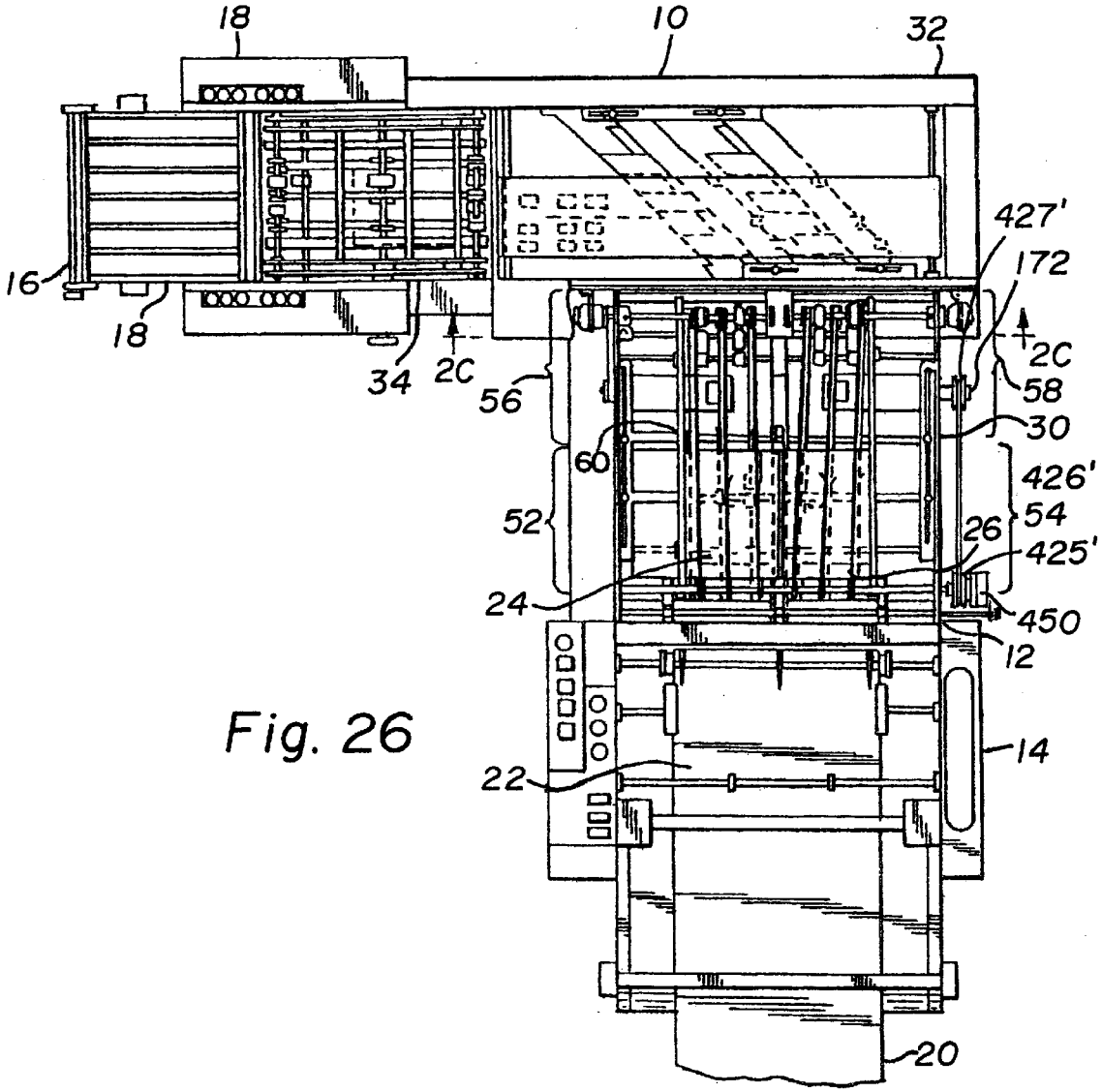
FIG. 26 is a plan view showing the general layout of the apparatus and including the addition of the register clutch as in FIG. 25.

Register streaking is mainly caused in the staging areas 52, 54 of the register 30 at the pinch point of the transport belt pulleys 42, 46. The invention provides, as shown in FIGS. 25–28, a disengagement clutch 450 to the upper register drive shaft 234 at the register input end 12. A clutched pulley 425' replaces the fixed pulley 425 in the previous design of U.S. Pat. No. 5,887,864 at FIG. 3. The fixed pulley 425 was driven by a belt 426 drivingly connected to a pulley 427 rotatably mounted on the main drive shaft 172, which continuously drove the input end 12 upper shaft 234. In FIG. 25, the belt 426' drives the clutched pulley 425' and is drivingly connected to pulley 427' mounted on the main drive shaft 172. The software control of this clutch 450 is set up to disengage the drive shaft belt 426' for the upper register belts 44 whenever a paper piece has completed its transit and becomes stationary. The start up delay of the clutch 450 is incorporated into software control to ensure that the belts 44 are up to speed before in-feeding from the cutter 14. The belts 44 are also turned on for a brief instant when paper is being ejected from the register stacking areas 56, 58 in order to assist with this paper movement caused by operation of brake and clutch assemblies 68, 70 at the output end of the register 30.

Improved Accumulator Paper Control

Figure 28:
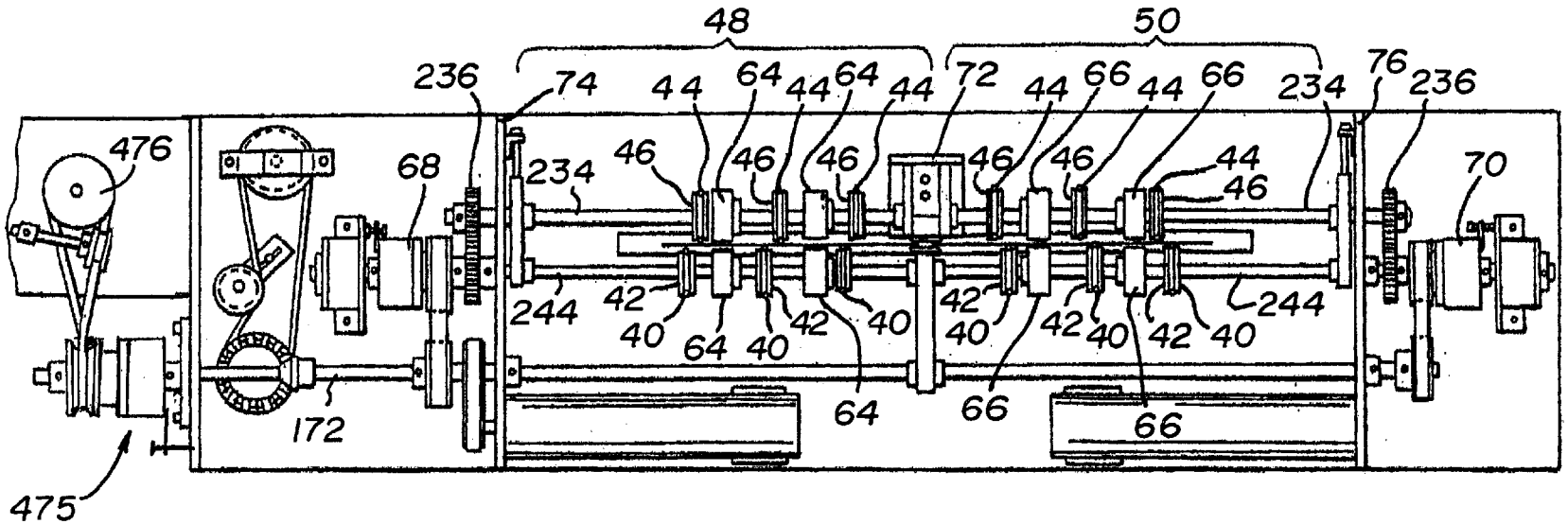
FIG. 28 is a front elevational view of the dual registering stacking interface including the main drive motor and drive shaft linked to the accumulator clutch and pulley as in FIG. 27.
Figure 29:
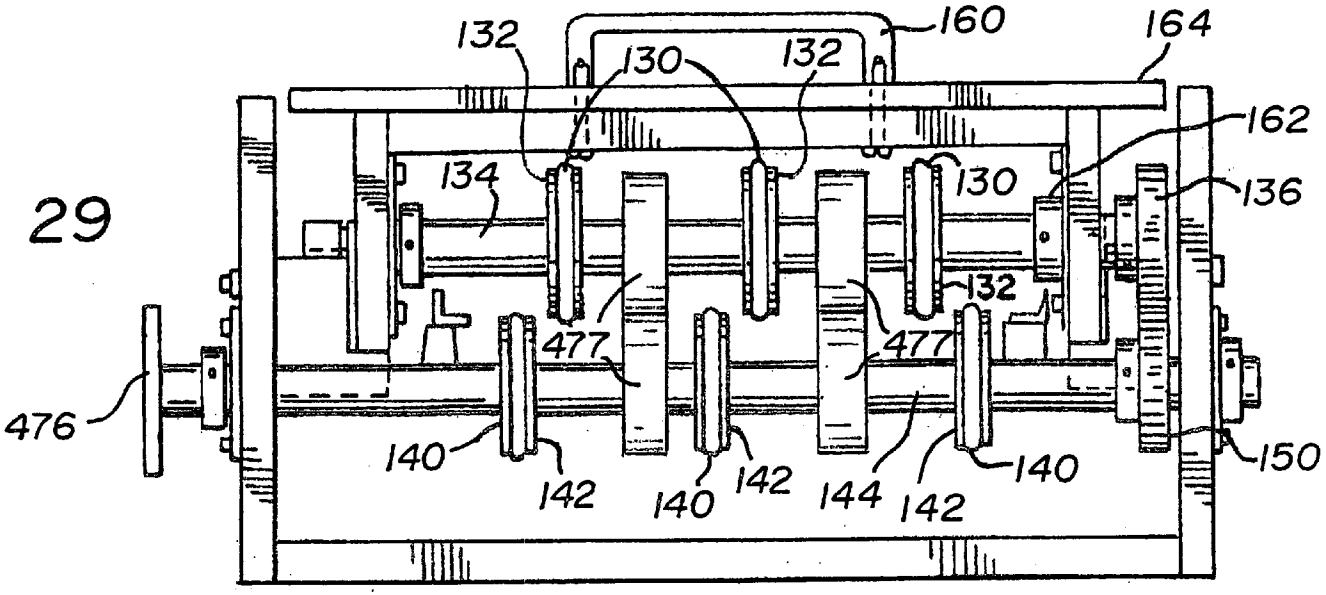
FIG. 29 is an end view of the access accumulator showing alignment blocks and latches and the relationship of top transport belts to lower transport belts, including the improvement comprising the additional of pinch rollers on the input end upper and lower drive shafts.
Figure 30:
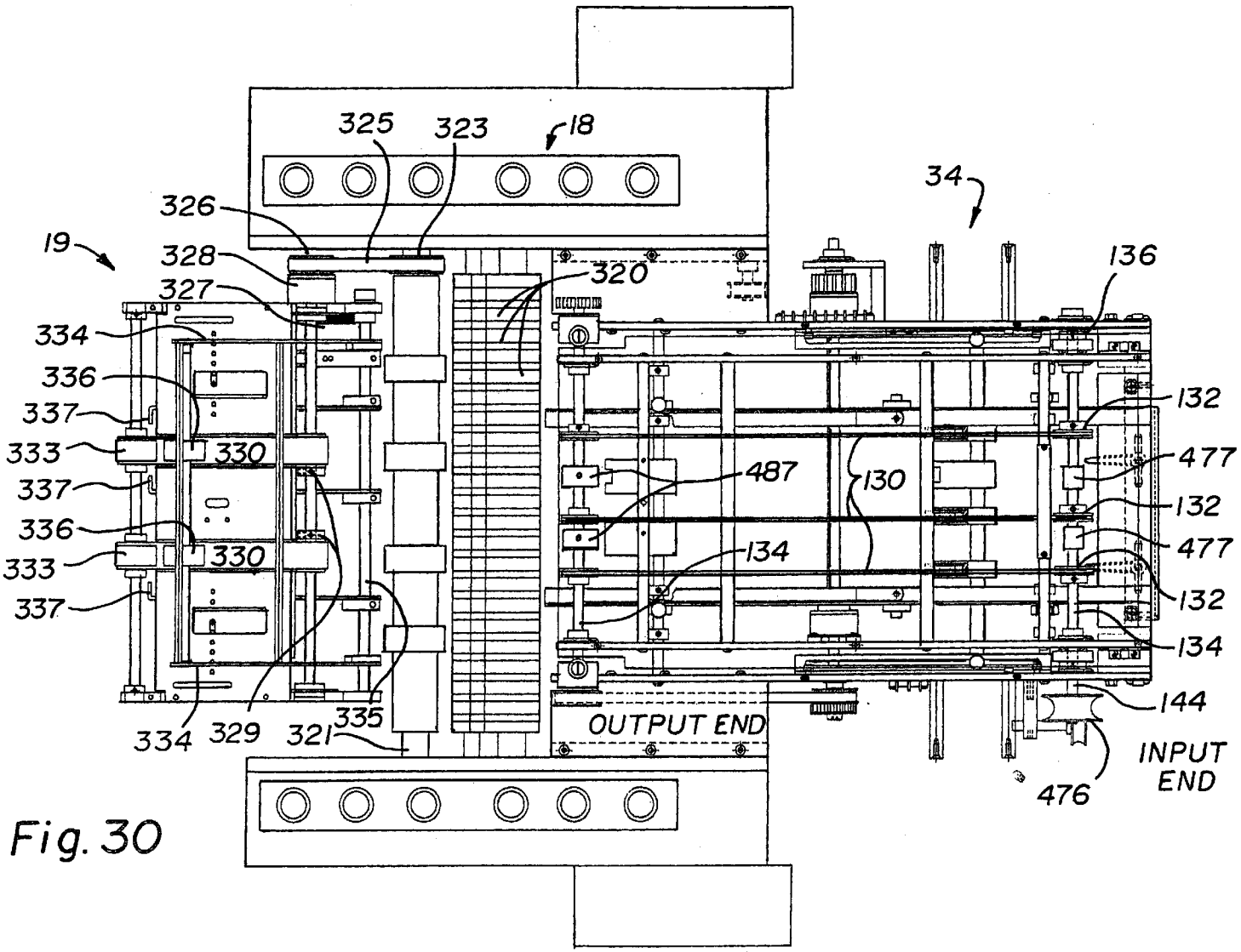
FIG. 30 is a detailed plan view similar to FIG. 6 and showing the accumulator and a portion of the folder removed to show the collector below.

The location and arrangement of the accumulator 34, the sequencer 32, folder 18, and collector 19 are shown in the perspective views in FIGS. 1 and 18, and in plan in FIG. 2. The accumulator 34 streaking is similar to the register 30 problem. To solve the problem, a disengagement clutch 475 has been added to the accumulator input drive pulley 476 and four additional in-feed pinch rollers 477 have also been added to the upper and lower accumulator in-feed shafts 134, 144. The clutch 475 location is shown in FIG. 27 and FIG. 28. The new in-feed pinch rollers 477 are shown in FIGS. 29 and 30. The drive arrangement for the upper and lower accumulator o-ring belts 130, 140 has been changed. Previously the upper and lower o-ring belts 130, 140 were all driven by the input roller shafts 134, 144. The lower belts 140 and output pinch rollers 487 now get their drive from the output end lower shaft 144. This means that they only move when paper is exiting the accumulator 34. This prevents the bottom sheet in a multi-page document from becoming streaked while waiting for the additional pages to be stacked on top. In effect the new accumulator clutch 475 controls the drive to the top belts 130 and new pinch rollers 477 of the accumulator 34. It does this through the bottom input roller shaft 144 driving the bottom drive gear 150 to drive the upper drive gear 136, and thereby drivingly rotate the upper drive shaft 134, as illustrated in FIG. 29. The input belt pulleys 142 of the upper belts 140 were previously fix mounted to the lower input drive shaft 144 and the output end belt pulleys 142 were ball bearing mounted on the lower output drive shaft 144 (FIG. 6). Ball bearing mounting allowed these output end pulleys 142 to act as idlers and share the same drive shaft mounting as the output rollers 478 yet, not be driven by the output pulleys now driven by output shaft 144. The invention reverses which end of the accumulator 34 that the fixed mount and bearing mount pulleys are located on. Accordingly, output end pulleys 142 are fix mounted on lower output shaft 144 and input pulleys 142 are ball bearing mounted on input drive shaft 144. This allows the lower input drive shaft 144 to turn without driving the lower accumulator belts 140. The need for the new pinch rollers 477 stems from the changes to the lower belts 140 drive. In the previous embodiment, the upper and lower belts 130, 140 always turned together. This allowed positioning the upper and lower input drive belt pulleys 132, 142 create a pinch point. That arrangement assisted in separating overlapped pages received from the sequencer 32 and also provided the extra force needed to deliver the page to the low friction paper guides 301. Since the upper and lower belts 130, 140 no longer turn together in the present invention, the new pinch rollers 477 provide the extra driving force. The software control logic would preferably set up in such a way as to minimize any paper idle belt movements.

Improved Collector Paper Control

A collector was not described in detail in said U.S. Pat. No. 5,887,864. Said patent generally showed the location of a collector underneath the folder 18. Herein, FIGS. 1 and 18, now show the collector to have reference numeral 19 generally residing underneath the folder 16 for receiving folded forms that had entered the folder 18 from the accumulator 34. In FIG. 18, the collector 19 would feed folded forms to the conveyor 410 and then to a mail inserter machine or the like.

Figure 31:
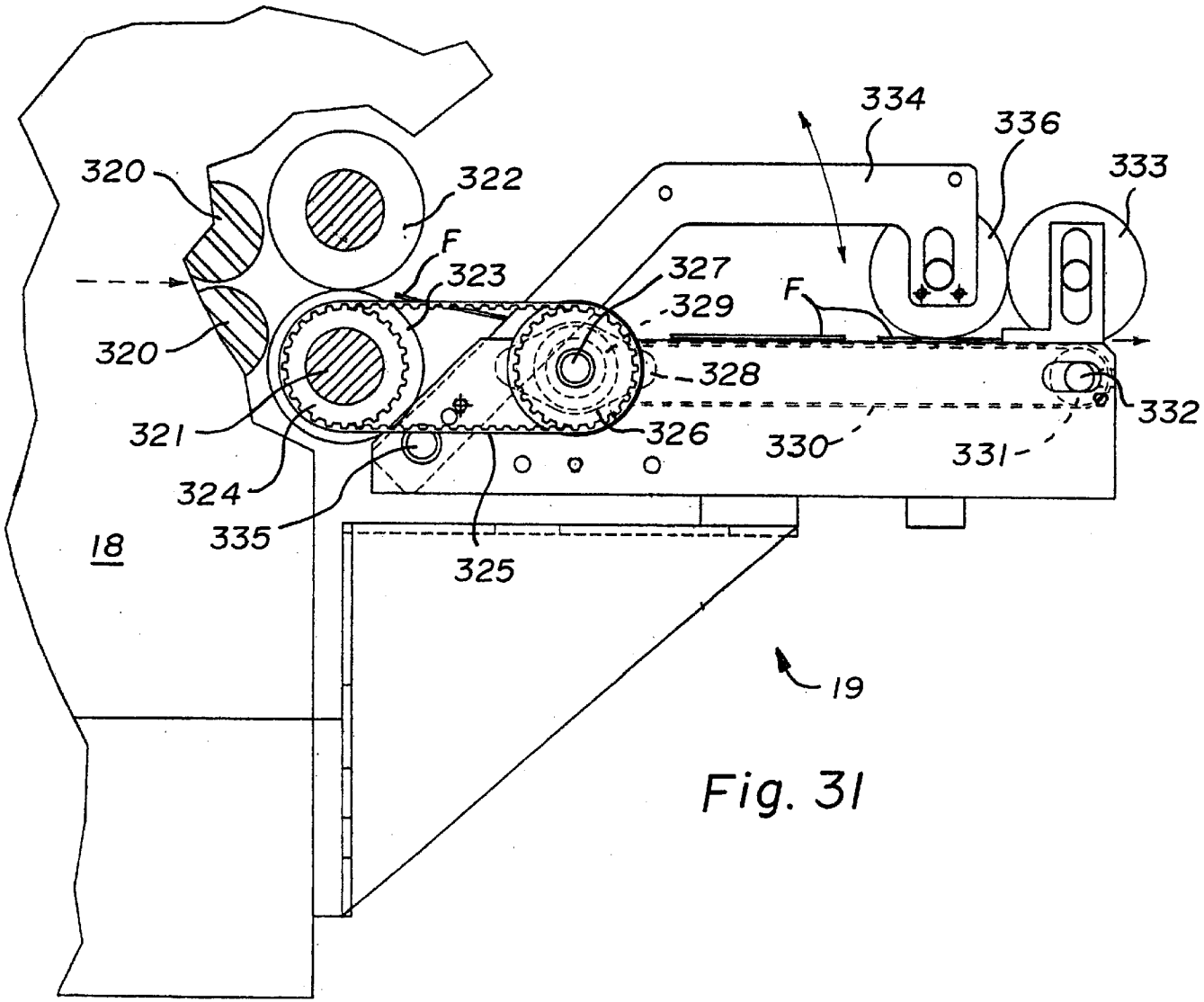
FIG. 31 is a schematic side elevational view of the output end of the folder and the collector.

With reference also to FIGS. 30 and 31, the collector 19 is shown in greater detail. In FIG. 30, a portion of the folder has been removed to illustrate the collector 19 therebelow. It will be seen that from the output end of the accumulator 34 (at rollers 487), the forms F are taken by folder rollers 320. The folder 18 and collector 19 are driven by a main drive shaft 321. As shown in FIG. 31, by the arrows between the folder rollers 320, the paper or form path takes the folded forms to the collector pinch rollers 322 and 323 for moving the forms outwardly thereof. The drive shaft 321 has a gear 324 mounted at the end thereof from which a toothed belt 325 is driven. The belt 325 drives a toothed drive pulley 326 of the collector 19. The drive pulley 326 is rotatably connected to a clutched collector shaft 327. A clutch 328 is provided to disengage the shaft 327 from the drive pulley 326 to stop shaft rotation. Input end pulleys 329 are mounted on the shaft 327 to rotate therewith and thereby move transport belts 330 engaged thereon. The transport belts 330 are engaged at the output end to idler pulleys 331. The idler pulleys 331 are rotatably mounted on a shaft 332 and are slaves to the pulleys 329. The output end, at the right side of FIG. 31, includes an upper, vertically slidable, idler pinch roller 333 under which the folded forms are dispensed as shown by the arrow. Dump roller arms 334 are movable up and down around a pivot shaft 335, which arms 334 are moved upwardly by software control until a form is disposed below spring loaded rollers 336 mounted thereon. Then the software program sequences the dump roller arms 334 to descend and create a spring-biased pinch under the spring loaded rollers 336 onto the form F therebelow and thereby also against the belts 330. The dump roller arms 334 are pivotally moveable upwardly around the pivot shaft 335 so that, when a folded form is moving toward the spring loaded rollers 336 pinch position, it is not forced to squeeze into the pinch point, but rather is moved to a ready position under the raised rollers 336 and thence the dump roller arms 334 are moved downwardly to place the rollers 336 against the form F when the software program signals that the form is ready to be fed outwardly between the output end pinch idler roller 333 and belt 330, as shown by the arrow at the right.

Thus, when a dump signal is given, the arms 334 move downwardly. The clutch 328 is engaged and the previously clutched shaft 327 is engaged by the drive pulley 326, whereby the belts 330 are then driven to move at the same time. The transport belts 330 are preferably flat and about one inch wide, but could be o-rings, or also solid thin belts, and equivalents. The transport belts in U.S. Pat. No. 5,887,864 were driven continuously by the folder drive shaft 321.

The folded documents are captured at the output end of the collector 19 by three upright movable "fingers" 337. These fingers 337 are lowered under solenoid control. This step along with the dumping and pinching of rollers 336, 333 against the moving transport belts 328, deliver the folded documents to, for example, the inserter track, i.e., conveyor 410. Streaking of form printing heretofore has been caused by the flat belts 330, and also by belts of the o-ring or equivalent construction, which continued to move while the printed paper (form F) was held captured in the collector 19 at the fingers 337. To remedy this, the clutch 328, which preferably is an electromagnetic disengagement clutch, was added to clutch the collector shaft 327 that drives the collector belts 330. The software control turns off the collector belts 330 whenever there is any significant paper idle time of about one-half second or more.

While several embodiments have been shown and described with respect to the present invention, it should be understood that the present invention is not limited to these embodiments, but rather is susceptible to numerous changes and modifications as known to those skilled in the art. Therefore, we do not wish to be limited to the detail shown and described herein, and intend to cover all such changes and modifications as are encompassed by the scope of the appended claims.

What is claimed:

1. An accumulator for receiving and stacking forms comprising:

a lower set of transport belts mounted on idler pulleys arranged along a lower input shaft driven by a first gear at an input end of said accumulator;

an upper set of transport belts mounted on pulleys arranged along an upper input shaft operatively connected to a second gear at said input end;

said second gear being driven by said first gear and said first gear being connected to a first drive;

a disengagement clutch for disengaging said lower shaft from said first drive;

said accumulator having an output end opposite the input end, wherein said upper and lower transport belts are mounted on pulleys arranged along upper and lower output shafts, said lower output shaft operably connected to a second drive, said output shafts drivingly connected whereby to be operable together; and, said second drive being operable independently of said first drive and wherein said disengagement clutch allows said lower input shaft to rotate without rotating said idler pulleys thereon.

2. The accumulator as in claim 1 wherein said upper and lower input shafts include pinch rollers mounted thereon to be rotatable therewith.

* * * * *